US005211725A

United States Patent [19]

Fowlie et al.

[11] Patent Number: 5,211,725

[45] Date of Patent: May 18, 1993

[54] METHOD FOR MANUFACTURING ABRASIVELY-TIPPED FLEXIBLE BRISTLES, AND FLEXIBLE ABRASIVE HONES THEREFROM

[76] Inventors: Robert G. Fowlie, 4413 Commonwealth Ave., La Canada, Calif. 91011; Tara L. Rands, 3200 Villa Knolls Dr., Pasadena, Calif. 91107

[21] Appl. No.: 743,733

[22] Filed: Aug. 12, 1991

[51] Int. Cl.[5] ..... B24D 3/00

[52] U.S. Cl. ..... 51/293; 51/295; 51/298; 51/307; 51/332; 51/334

[58] Field of Search ..... 51/293, 295, 298, 307, 51/332, 334

[56] References Cited

U.S. PATENT DOCUMENTS

| | | | |
|---|---|---|---|
| 3,577,839 | 5/1971 | Charvat et al. | 51/298 |
| 3,696,563 | 10/1972 | Rands | 51/332 |
| 3,871,139 | 3/1975 | Rands | 51/334 |
| 3,885,358 | 5/1979 | Enzian | 51/298 |
| 4,133,147 | 1/1979 | Swift, Jr. | 51/295 |
| 4,852,998 | 8/1989 | Kopp | 51/309 |
| 5,045,091 | 9/1991 | Abrahamson et al. | 51/293 |

*Primary Examiner*—Mark L. Bell
*Assistant Examiner*—Willie J. Thompson

[57] ABSTRACT

A method for producing, per se, individual or multiple enlarged-abrasive-globule-carrying flexible bristle(s), with each abrasive globule being firmly and fixedly, and virtually non-accidentally-removably, attached to, and thereby carried on, a corresponding tip end portion of a corresponding flexible (often nylon plastic) bristle, achieved by successive and intermixed and/or alternating multiple-adhesive-matrix-and-abrasive-particle-applicatory steps, a junction-strength-increasing step, multiple laminating and curing steps; and a multiple, composite form of the above-defined method, comprising a method for producing a flexible abrasive hone by assembling a generally similar plurality of such enlarged-abrasive-globule-carrying flexible bristles and effectively firmly mounting bristle rear end portions with respect to a bristle-holding base in a relatively evenly spaced-apart manner and with the bristle tip end portions and the bristle rear end portions being generally similarly longitudinally-spaced, along bristle lengths, such that each enlarged abrasive globule of the plurality thereof, and all of same, is/are positioned at generally similar bristle-length-spaced forward honing locations in closely-laterally-adjacent-to-each-other, but individual and non-interfering positions, and, thereby, together defining an effective multi-element, common, flexibly-supported honing surface.

24 Claims, 12 Drawing Sheets

FIG. 17
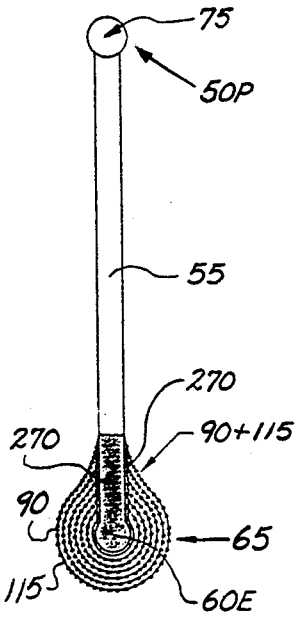
FIG. 18
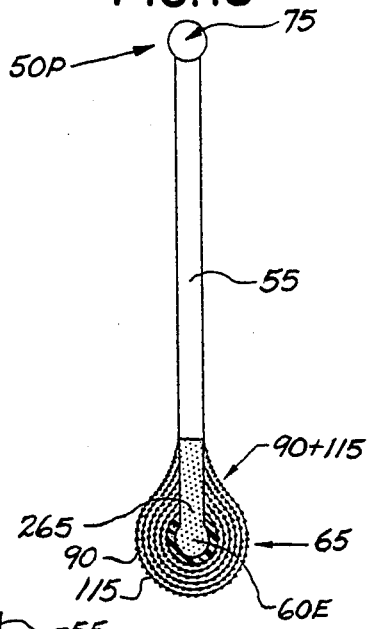
FIG. 19
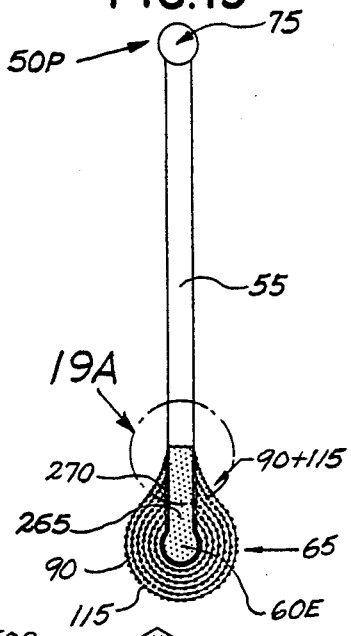
FIG. 19A
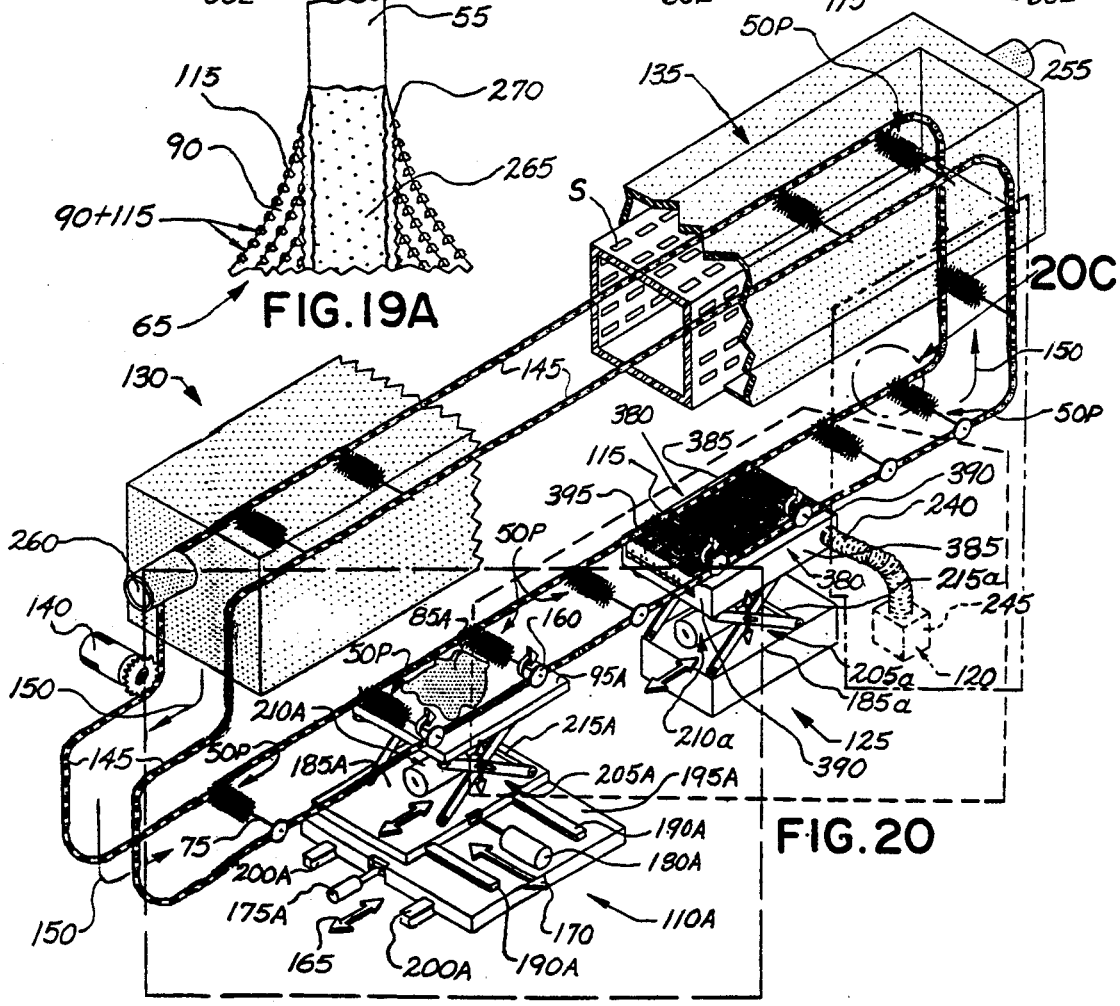
FIG. 20

20C
145
150
155
130
50P
380
390
240
245
120
125
385
115
395
160
85A
95A
215A
205A
190A
195A
110A
215a
205a
185a
210a
101
100

255'
115' ALTERNATE
125' ALTERNATE
240
245
120
210d
205a'
125'
220'
210a'
205A'
110A'
50P
155'
115F
135'
S
85A'
112
95A
270
265
111
210A'
205c
110B
210c
110S
205b
210b
145'
140'
260'
130'
60
155
55
75
90+115
145

METHOD FOR MANUFACTURING ABRASIVELY-TIPPED FLEXIBLE BRISTLES, AND FLEXIBLE ABRASIVE HONES THEREFROM

BACKGROUND OF THE INVENTION

The field of the present invention is, generally, that of methods of manufacturing abrasive hones and abrasive brushes of certain types intended, generally, for abrading, grinding, polishing and honing usage, usually, in a power-driven manner (although, not always so powered). More particularly, the field of the present invention is that of methods of manufacturing abrasive hones and abrasive brushes of certain more specific types intended for particularly heavy-duty usage, extended-time hard usage, and/or extremely-variable-contact-pressure usage, or any other type of usage which has been found in the past conventional prior art practice to frequently lead to breakage of the very frangible and brittle conventional prior art grinding and/or honing "stones" or "sticks", etc., (or other abrading member made of such easily cracked, easily broken, or even easily shattered abrasive material—such as a cast tungsten carbide grinding or honing tool, for example, although not so limited). Such extremely-variable-contact-pressure usage (which in the past has been found to be so destructive to a conventional prior art very frangible and brittle abrading tool) may be said to include power-driven abrading or honing operations where a workpiece which is to be honed has substantial workpiece surface discontinuities and/or irregularities (especially unexpected and/or unpredictable surface irregularities, etc.), and, also, power-driven abrading or honing operations of a rotary (or rotating) nature and where the power- driven (rotating) abrading tool is non-symmetrically positioned relative to a curved workpiece surface which is to be abraded or honed. Either of these just-described types of prior art extremely-variable-contact-pressure usage have been so destructive to the aforementioned types of very brittle and frangible prior art abrading and honing tools, that attempts have been made in the more recent past to solve (or, at the very least, to mitigate) this prior art brittleness-caused tool-breakage problem by flexibly, or resiliently, mounting the abrading (or honing) element or material so undesired tool-workpiece contact pressure peaks would be minimized [by the flexible mounting of the abrading (or honing) element] and such tool-breakage would be substantially eliminated (or at least greatly inhibited and reduced). One such recent prior art solution attempt has comprised the mounting of small quantities of the abrasive material (in what might be termed "globule" form) on the ends of a plurality of flexible bristles of what might be termed a flexible abrasive brush (or a flexible abrasive hone), and manufacturing methods for producing same.

However, in the above-mentioned type of flexible abrasive hone, it has been found to be very difficult to avoid "chipping" away or "chipping" off such abrasive "globules" (or parts thereof) from the flexible bristle tips mounting same during, or as a result of, hard honing usage thereof—and any method of manufacturing same that would solve this problem would be extremely desirable, and it is precisely such an improved method of manufacturing such strongly-adhering, abrasively-tipped flexible bristles [and for manufacturing virtually non-chippable (as to the abrasive tips thereof) flexible abrasive hones therefrom] that is the essential inventive concept of (and that is taught by) the following teachings and disclosure and claims of the present invention, and which provide positive advantages, which virtually completely overcome the hereinbefore-mentioned prior art major problems and difficulties. The advantages effectively flow from, and occur by reason of, the specific features of the novel method of the present invention as pointed out in greater detail hereinafter. Please note that no prior art *method* patents for producing apparatus of the foregoing types have been found.

SUMMARY OF THE INVENTION

Generally speaking, the novel method of the present invention comprises a process (or procedure) for producing an enlarged multi-phase, usually initially-liquid-but-hardened-into-solid globule (usually, an abrasive globule) firmly and fixedly and virtually non-accidentally-removably and non-detachably carried on a tip end portion of a bristle (usually, a flexible bristle), usually intended for appropriate mounting and positioning for joint cooperation with a plurality of other similarly abrasively tipped bristles to effectively form a flexible abrasive hone (which shall be broadly construed herein to include medium- finish abrading action and coarse-finish abrading action in addition to the conventionally understood very-fine-finish near-to-polishing and actual-polishing types of abrading action), although not specifically so limited in all forms of the novel method of the present invention. The novel method of the present invention includes multiple method steps of varying degrees of operational importance and/or varying degrees of patentable-significance importance, as briefly detailed immediately hereinafter.

The method steps mentioned in the foregoing paragraph may include any or all of the following method steps as is appropriate to achieving any of various different corresponding end-results.

Generally, the method starts by performing a first coating applicatory step taking the form of applying an at least semi-liquid (partially liquid, etc.), but controllably hardenable, effectively adhesive, matrix means and material to a tip end portion of a bristle (usually, a flexible bristle, such as a nylon plastic resin bristle—although, not so limited in all forms thereof) in what might be termed a first exterior coat and lamina of the adhesive matrix means and material (often an at least partially liquid epoxy resin plastic material—although, not so limited in all forms thereof) of a desired lamina thickness, as often determined in part by the natural retention characteristic of the now first-coated bristle tip end portion upon termination of the first-coating applicatory step (made while the epoxy resin is still liquid and before it is later hardened and cured) although other characteristics and/or parameters, such as viscosity of the applied liquid adhesive matrix means and material (usually epoxy resin) and/or the surface to surface intermolecular (unbalanced-out) attractive forces (related to surface-tension effects, capillary action effects, "wicking" action effects, etc.) may enter into (and effectively moderate) said "retention characteristics" of the "first-coated bristle tip end portion".

The first coating applicatory step, just mentioned immediately hereinbefore, also, effectively comprises an immobilizing step, in that the application of the adhesive matrix means and material (such as liquid epoxy resin, although not so limited) to the bristle tip end portion (often made of nylon plastic resin material, although not so limited) is effectively controlled, modified, and limited such as to effectively cause the relatively non-movable effective-fixing and immobilizing of the first exterior coat and lamina of the first-applied adhesive matrix means and material relative to the bristle tip end portion carrying same (coated thereby), so as to substantially inhibit and prevent positional displacement of excess portions of the still liquid adhesive matrix means and material from occurring on, and along, the bristle tip end portion carrying same.

The next method step comprises the performing of an abrasive particle, supplementary and additive, applicatory step usually taking the form of bringing a quantity of usually initially dry additive abrasive particles of finely-divided particulate abrasive material (such as tungsten carbide, or silicon carbide particles, or "grit'-'—although not so limited) into mating and bonding contact thereof with the previously applied exterior coat and lamina of the still liquid adhesive matrix means and material (epoxy resin), and thereby causing the effective picking-up of the abrasive particles by the adhesive matrix means and material (epoxy resin) and the effective intermixing thereof into an effective two-phase, composite abrasive-matrix material.

The next step in the novel method of the present invention comprises the performing of a composite-material-hardening and composite-material-curing step taking the form of subjecting the bristle tip end portion, carrying thereon the coat and lamina (comprising the immediately-hereinbefore-mentioned effective two-phase, composite abrasive-matrix material) to the particular required physical conditions needed for hardening and curing same (often, to heat applied thereto at an appropriate curing temperature for an appropriate time—although, not so limited), whereby to cause such hardening and curing of the composite abrasive-matrix material (comprising the hardened-in-place exterior coat and lamina on the bristle tip end portion) to occur to a desired extent.

In one preferred form of the novel method of the present invention, as broadly defined immediately hereinbefore, the sequence of hereinbefore-described steps is/are repeated as many times as the number of laminations desired in the ultimate, enlarged abrasive globule produced thereby.

In one slightly-extended form of the novel method of the present invention, an additional adhesiveness-increasing, bristle-tip-end portion mounting-preparation step is performed before the previously-mentioned first coating applicatory step and takes the form of effectively scarifying (roughening, etc.) the otherwise smooth exterior surface of the bristle tip end portion, thus effectively increasing the useful surface area thereof available for adhesive purposes, while also greatly increasing the effective "adhesiveness" of that surface which is available for such "adhesive purposes".

In another slightly extended form of the novel method of the present invention another adhesiveness-increasing operation is performed before the previously-mentioned first coating applicatory step and takes the form of the performing of a junction-enhancing bridging step comprising applying interjunctionary adhesive bonding (bridging) material of an initially non-solid and uncured type to the exterior surface of the bristle tip end portion, with said interjunctionary adhesive bonding and bridging material, also, being of a type characterized by having a first strong attraction affinity for the material forming the bristle tip end portion (such as nylon, for example, although not so limited) and, additionally, having a second strong attraction affinity for said adhesive matrix means and material (such as epoxy resin, for example, although not so limited) of said first exterior coat and lamina, which is to be subsequently applied thereto immediately thereafter in said first coating applicatory step.

Either of the two preceding method steps may be performed independently of the other (and without the other step being performed at all), or both of the two preceding steps may be performed (in the order set forth hereinbefore) for maximum junction strength.

An important point to note is that the adhesive matrix applicatory step, the immobilizing step, and/or the effective composite thereof, in one preferred exemplary form of the novel method of the present invention, involves a relative applicatory and/or "wiping" motion (described in detail hereinafter) which effectively causes, or brings about, the desired controlled and/or modified and/or limited application of the liquid adhesive matrix means and material (such as epoxy resin, although not so limited) to the bristle tip (end portion) in a most effective and totally distinctive-from-the-prior-art manner. This type of "relative applicatory and/or wiping motion" may also be advantageously used for applying "scarifying" material in the so-called "scarifying" step and/or for applying "bridging" material in the so-called "bridging" step; again, in a manner having no known prior art anticipation whatsoever.

Up to the present time, it has been found to be most advantageous to virtually non-removably and virtually non-chippably mount each such enlarged, multi-phase, abrasive globule on the "end", the end "portion", the "tip end", or the "tip end portion" (all of which terms have been used substantially interchangeably herein) of the corresponding bristle (usually, a flexible bristle, although not always so limited). However, it should be noted that the present invention also includes the positioning of such an enlarged abrasive globule at (a) bristle-mounted location(s) other than on the bristle tip end portion(s), etc. This may be true of all the bristles, some of the bristles, or none of the bristles of an abrasive hone (which shall be construed to mean a grinding or abrading tool of any type). Furthermore, different bristles of a multi-bristle abrasive hone may have their enlarged abrasive globules located at different relative positions with respect to the corresponding different bristles of such an abrasive hone, etc. Therefore, the four just-mentioned expressions [used through this specification (including the claims) to identify the bristle position where such an enlarged abrasive globule is located] should be very broadly construed to include the meaning of a "selected portion" of each such bristle, etc. This broad interpretation of said four just-mentioned expressions avoids the necessity (otherwise) of unnecessarily adding to the length of the already lengthy present specification in order to separately set out and individually describe each different type of abrasive globule location, in particular detail. For one (of many) non-limiting examples, please note than an intermediate (in some cases, central) location of an enlarged abrasive globule on a centrally outwardly-bowed bristle would cause the enlarged abrasive globule to extend (or project) into a conveniently useful abrading position (and, in fact, a flexibly supported abrading position, etc.) ready for a slightly different power-driven, flexibly-supported abrading (honing, etc.) action.

OBJECTS OF THE INVENTION

With the above points in mind, it is an object of the present invention to provide a novel method for producing individual or multiple enlarged-abrasive-globule-carrying bristle(s) [usually, flexible bristle(s)], with each abrasive globule being firmly and fixedly, and virtually non-accidentally-removably, attached to, and thereby carried on (and by) a corresponding bristle (often, a flexible nylon plastic resin bristle, although not always so limited).

It is a further object to provide a novel method for producing individual or multiple enlarged-abrasive-globule-carrying bristle(s) in the manner set forth in the preceding object and further achieved by successive and/or intermixed and/or alternating multiple adhesive-matrix-and-abrasive-particle-applicatory steps, etc., and multiple laminating and curing steps.

It is a further object to provide a novel method for producing individual or multiple enlarged-abrasive-globule-carrying bristle(s) in the manner set forth in the second preceding object and further achieved by successive and/or intermixed and/or alternating multiple adhesive-matrix-and-abrasive-particle-applicatory steps, either of two different junction-strength-increasing steps (or both), and multiple laminating and curing steps.

It is a further object to provide a novel multiple, composite form of any of the three method versions set forth in the three immediately preceding paragraphs for producing an abrasive hone (usually a flexible abrading tool, such as a flexible hone, although not always so limited) by assembling a generally similar plurality of such enlarged-abrasive-globule- carrying bristles (usually, flexible bristles, although not always so limited) and effectively firmly mounting other spaced-therefrom bristle portions (usually, bristle rear end portions, although not always so limited) with respect to bristle-holding base means so as to operatively mount the plurality of enlarged abrasive globules—usually, in a relatively evenly-spaced-apart manner and, further, usually in a relatively similar, evenly-spaced-from-the-base-means manner (although, not always so limited), such that each enlarged abrasive globule (or most of same) is/are positioned at generally similar forward honing locations in closely-laterally-adjacent-to-each-other, but individual and non-interfering positions and, thereby, together defining an effective multi-element, common, honing surface (usually, a flexibly-supported, common honing surface, although not always so limited).

It is a further object to provide an improved method or process of the general character referred to in the foregoing Objects, Summary and elsewhere in this present specification, and referred to in the various described features thereof, in any and all possible combinations thereof, generically and/or specifically, and which may include any or all of said features, either individually, or in combination, and which is capable of substantially reducing the cost(s) of manufacturing such really effective abrasive honing apparatus (usually, such a flexibly-mounted abrading brush having a plurality of such individually-flexibly-mounted enlarged abrasive globules, although not always so limited).

Further objects are implicit in the detailed description which follows hereinafter (which is to be considered as exemplary of, but not specifically limiting, the present invention), and such further objects will be apparent to persons skilled in the art after careful study of the detailed description that follows.

For the purpose of clarifying the nature of the novel method of the present invention, several representative, but non-limiting, exemplifications of the invention are shown, in a plurality of method steps, as fragmentarily, diagrammatically, and representationally-only illustrated in the hereinafter-described Figures of the accompanying drawings.

BRIEF DESCRIPTION OF THE DRAWINGS

As shown in FIG. 9, this comprises the roughening and/or scarifying of the outer surface of the bristle tip end portion to make it effectively rougher and/or more porous than before such treatment.

FIG. 17 is a view very much like FIG. 13, but (similar to the showing of FIG. 14) shows a slightly modified, and junction-strength-increased mounting of the enlarged abrasive globule on the already-enlarged bristle tip end, produced in one representative additional "bridging, etc." method step such as that shown in FIG. 10, for example (although, not specifically so limited in all forms of the invention); applied, however, to the already-enlarged bristle tip end of FIG. 11 (or equivalent).

FIG. 18 is another view very much like FIG. 13, but (similar to the showing of FIG. 15) shows a different-from-FIG. 17 modified, and junction-strength-increased mounting of the enlarged abrasive globule on the already-enlarged bristle tip end, produced in another representative additional "scarifying" method step such as is shown in FIG. 9, for example (although, not specifically so limited in all forms of the invention); applied to the already-enlarged bristle tip end of FIG. 11 (or equivalent), however.

FIG. 19 is substantially a combination of FIGS. 17 and 18 and shows both types of junction-strength-increasing mounting of the enlarged abrasive globule on the already-enlarged bristle tip end, produced in this representative example, by sequentially using the additional "scarifying" method step shown in FIG. 9 (or effective equivalent), and then, the additional "bridging, etc." method step shown in FIG. 10 (or effective equivalent), although not specifically limited to the showing of either FIG. 9 or FIG. 10; both being applied, however, to the already-enlarged bristle tip end of FIG. 11 (or equivalent).

FIG. 19A is a fragmentary enlargement of that portion of FIG. 19 lying within the circle indicated by the arrow 19A in FIG. 19.

FIG. 20 is a fragmentary (partial), somewhat diagrammatic and skeletonized, oblique (three-dimensional) view illustrating, in simplified form, one exemplary-only representational showing of one very simple (but non-specifically limiting) basic method of the present invention, with certain well-known-in-the-art types of parts, or portions, of the particular exemplary apparatus used in this example in practicing the novel method of the present invention, being removed and not shown for reasons of drawing simplification—and also, for reasons of drawing clarity and, consequently, greatly enhanced understanding (understandability) of the real inventive principles of the important inventive concept of the present invention.

DESCRIPTION OF CERTAIN (OF MANY) PREFERRED FORMS

Method Steps of the Present Invention

Figure 1:
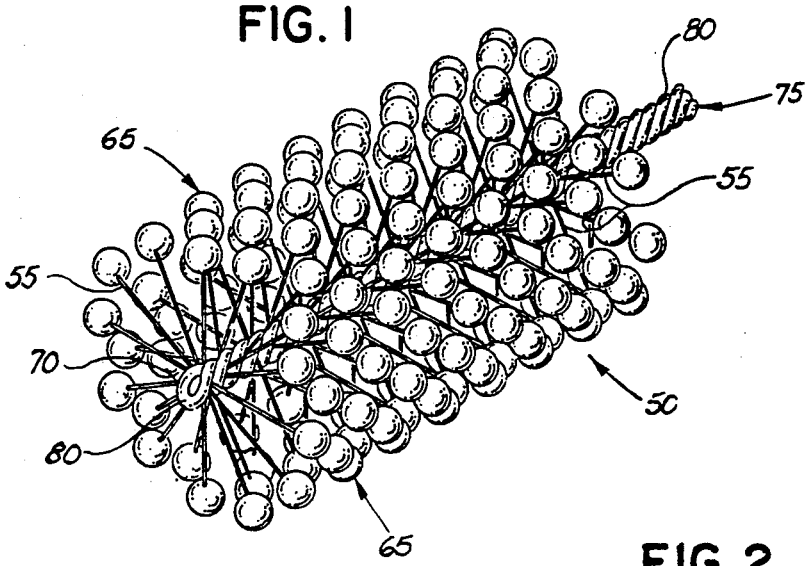
FIG. 1 is an oblique, three-dimensional view of one exemplary, but non-limiting, flexible abrasive hone produced by, and through the use of, the novel method of the present invention in two different aspects—first, a novel method for producing enlarged-abrasive-globule-carrying flexible bristle constructions (or bristles) per se; and, second, a novel method for producing such a flexible abrasive hone from multiple such enlarged-abrasive-globule-carrying flexible bristle constructions (or bristles) assembled, spacially related, and mounted in one particular exemplary way which causes the hone to present a flexibly mounted, common, substantially cylindrical, outer, composite, effective honing surface made up of a plurality of closely adjacent (or closely packed), but still individual and non-interfering-with-each-other enlarged abrasive globules.

Several exemplary, but non-limiting, forms of the novel method of the present invention will be described hereinafter by referring to a first basic series of basic method steps (such as indicated at the corresponding multiple different basic method step "stations" shown very diagrammatically in FIG. 20) and by referring to a second extended series of method steps [such as indicated at the corresponding increased number (effectively extended number) of different extended-beyond-basic method step "stations" shown very diagrammatically in FIG. 21].

Each of said two different series of method steps (and the various different individual method steps comprising same) is/are shown individually in various different ones of the drawing figures, as specifically indicated and identified elsewhere herein, and, as so shown, said method steps are illustrated as utilizing certain exemplary, and non-limiting structures, articles of manufacture, apparatuses, equipments and/or machines for the performance of certain operations and/or movements which are part of any or all of the novel method steps of the present invention; but which, optionally, can be performed otherwise—by other machines or by a human operator, etc., thus, in no way apparatus-limiting the novel method of the present invention.

Also, as illustrated for non-limiting, exemplary purposes only, said method steps are shown as producing (1) a particular, specific form of individual part, and/or (2) a particular, specific form of composite part; with each such individual part being shown as comprising an enlarged-abrasive-globule-carrying flexible bristle (of particular construction), and with each such composite part being shown as comprising a flexible abrasive hone made by assembling a plurality of such enlarged-abrasive-globule-carrying flexible bristles and effectively (at least temporarily) firmly mounting bristle rear end portions (or auxiliary structures effectively holding same) with respect to a bristle-holding base. In the form illustrated (for exemplary, but non-limiting purposes), the multiple bristles of said composite part (flexible abrasive hone) are effectively mounted relative to said bristle-holding base in a relatively evenly spaced-apart manner with the bristle tip end portions and the bristle rear end portions being generally similarly longitudinally-spaced-apart along bristle lengths such that each enlarged abrasive globule of the plurality thereof (usually, all of same, although not always specifically so limited) is/are positioned at generally similar, bristle-length-spaced forward honing locations (sometimes outer honing locations, inner honing locations, or other honing locations) usually, in closely-laterally-adjacent-to-each-other, but individual and non-interfering positions, and thereby, together, defining an effective multi-element, common-configuration, flexibly-supported honing surface.

However, it should be clearly understood that the present invention, and the present specification (including the appended claims) are not limited by either said structures, apparatuses, equipments, and/or machines shown as being used in the illustrations of the novel method of the present invention, or by the two different illustrated final parts produced by the novel method of the present invention (or various modifications of said final parts so produced)—all of said real physical structures being subject to change within the broad scope of the novel method of the present invention, and the following outline description of the novel method of the present invention (and variations thereof) should be read and understood "in the light of" the foregoing statement, and with it clearly "in mind".

Figure 3:
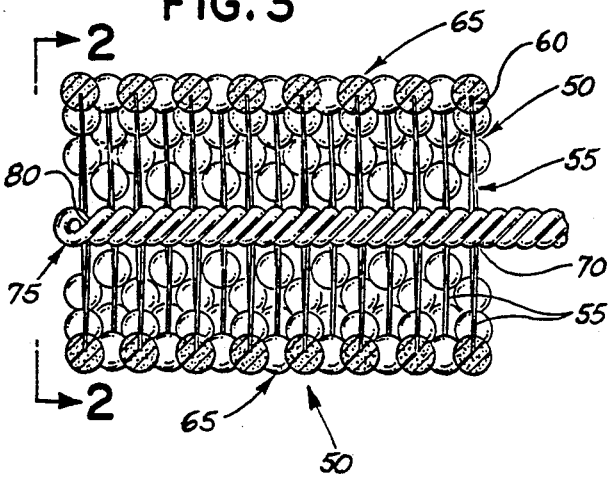
FIG. 3 is a view, partly in side elevation and partly in side section, taken along the plane indicated by, and in the direction indicated by, the arrows 3—3 of FIG. 2.
Figure 2:
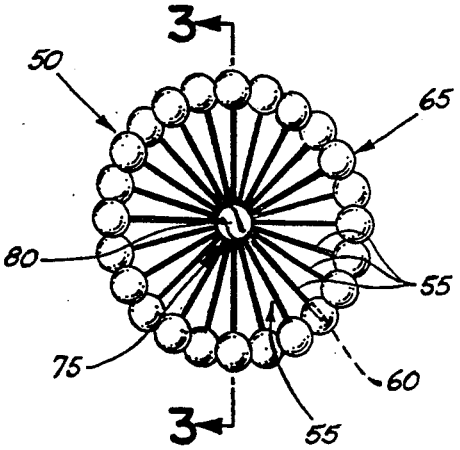
FIG. 2 is an end elevational view of the first exemplary, but non-limiting, showing of FIG. 1, as indicated by the arrows 2—2 of FIG. 3.

Generally speaking one exemplary such flexible abrasive hone is indicated at 50 in FIGS. 1–3, inclusive, and it is shown in an exemplary one of many possible forms which it may take within the broad scope of the novel method of the present invention. As shown, it includes a plurality of bristles, most of which are similar to some of the individual enlarged-abrasive-globule-carrying flexible bristles already referred to hereinbefore and individually illustrated in many of the figures of the accompanying patent drawings. As shown in FIGS. 1–3, inclusive, said bristles are indicated at 55 and are shown as being of flexible construction (sometimes flexible plastic material construction, sometimes flexible nylon plastic material construction, and/or sometimes of other suitable flexible material construction), with forward (or outer) bristle tip ends 60 being provided with and virtually non-chippably carrying corresponding ones of such enlarged abrasive globules 65 (most of which are similar to at least some of the individual enlarged abrasive globules already referred to hereinbefore and individually illustrated in great detail as to both method of manufacture and consequent construction in many of the Figures of the accompanying patent drawings).

As shown in FIGS. 1–3, inclusive, the bristles 55 have effective inner, or rear, end portions indicated at 70 which are effectively held, or mounted, by a bristle-holding base, shown in an exemplary one of many possible forms thereof at 75 in FIGS. 1–3, inclusive (comprising a twisted wire 80 effectively engaging and holding the bristle rear ends 75, as shown—although, not specifically so limited).

The arrangement is such that the multiple enlarged abrasive globules 65 are positioned at generally similar bristle-length-spaced forward (outer, in the non-limiting example shown) honing locations in closely-laterally-adjacent-to-each-other but individual and non-interfering positions, and to, thereby, together define an effective multi-element, common-configuration, flexible-supported honing surface (comprising the effective outer peripheral surface of the complete flexible abrasive hone 50).

The present invention, primarily, relates to the novel method of manufacture (and variations thereof) employed in making (producing) each of the enlarged abrasive globules 65 and effectively non-chippably and non-removably mounting said enlarged abrasive globule 65 on its corresponding bristle tip end 60, and the basic method for doing so will now be particularly described, with special reference to FIGS. 4–8, inclusive, and to FIG. 20.

Figure 4:
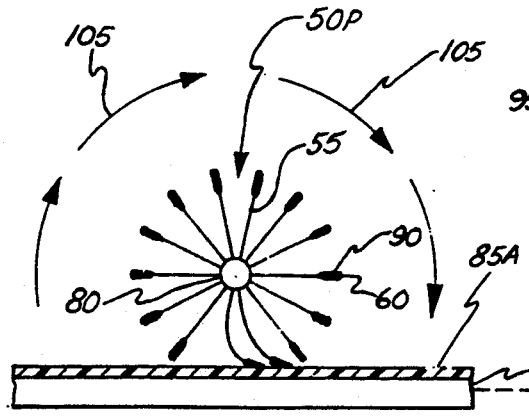
FIG. 4 is a view generally similar to FIG. 2, but shows an exemplary first step in the novel method for the production of the novel bristle-mounted-enlarged-abrasive-globule on each of the flexible bristle tip ends (or end portions) and comprising a first coating applicatory step for applying an at least semi-liquid, but controllably hardenable, effectively adhesive, plastic matrix means and material to the tip end portion of each of the multiple bristles shown. This view, also, shows, in combination with said first coating applicatory step, the effective performance of an effective immobilizing step, wherein the first exterior coat (lamina) of said semi-liquid plastic matrix means (material) is then rotatingly, wipingly, and under pressure, thinned so as to become, and to subsequently be, substantially effectively immobilized against subsequent physical-positional, liquid-running-displacement thereof relative to the bristle tip end portion to which the semi-liquid matrix means (material) has been applied and which, thus, carries the first exterior coat (lamina) thereon.

The first basic step in the simplified basic form of the novel method of the present invention is illustrated very diagrammatically in FIG. 4, wherein said first basic step is shown in multiple—that is, with respect to a plurality of (a representational, but reduced number) the individual bristles making up a complete flexible abrasive hone of one novel self-centering, self-sizing type. In this view (FIG. 4) one exemplary, non-limiting version of a first coating applicatory step of the present invention is shown in part and comprises the performing of such a first coating applicatory step, taking the form of applying an at least semi-liquid, but controllably hardenable (curable), effectively adhesive, matrix means 85A to a tip end portion 60 of each bristle 55 in a manner which will produce on said bristle tip end portion 60 a first exterior coat (and lamina) 90 made up (comprised) of the material comprising said matrix means 85A. In the exemplary, non-limiting arrangement diagrammatically and fragmentarily shown in FIG. 4, the matrix means 85A may comprise an initially liquid or semi-liquid adhesive plastic resin matrix means (material) such as an epoxy resin, for example, and may initially be carried upon (usually thin-coated upon) an underlying table (or support) 95A and the bristle tip ends 60 are wipingly relatively rotatively moved with respect to the table (or support) 95A (such as is indicated diagrammatically at 100) while being forcibly biased there against, which effectively applies a thin layer of the matrix means 85A around the entire tip end 60 of each bristle 55, and along only a 5 relatively short, predetermined length thereof, so that each bristle so subjected to said first coating applicatory step will end up with a similar thin exterior coat 90.

Inasmuch as the materal comprising each such exterior coat 90 is semi-liquid it could very easily move along the intermediate (or shaft) portion of a bristle 55 so as to be displaced from its desired end position on only a relatively short length of the corresponding bristle tip end if it is not somehow effectively restrained, or immobilized, against such undesired movement.

Figure 5:
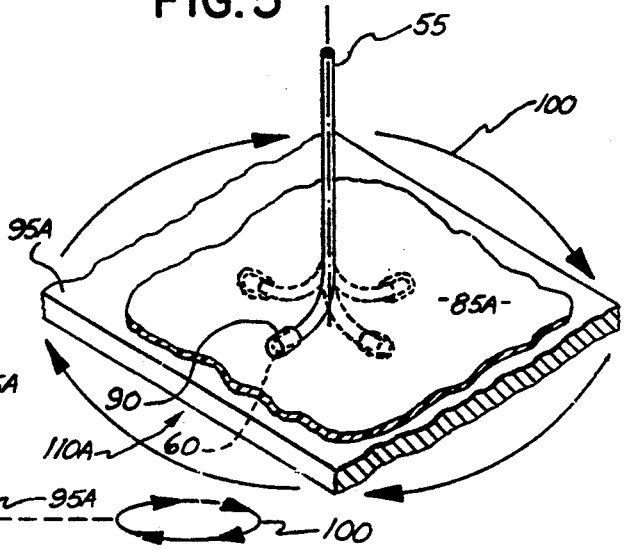
FIG. 5 is a fragmentary, partially broken-away view and shows a single representative and exemplary (but non-limiting) bristle part of the many such bristle parts shown in FIG. 4, arbitrarily shown along and removed from all of the other such bristle parts actually physically present in FIG. 4, for reasons of drawing clarification and simplification.

Therefore, the first coating applicatory step referred to hereinbefore and diagrammatically shown (in multiple) in FIG. 4 (and individually shown in FIG. 5) also, effectively comprises an immobilizing step, in that the application of the matrix means layer 85A carried on top of the relatively movable table 95A to each bristle tip end portion 60 is effectively limited and/or controlled and/or modified such as to cause the relatively non-movable [relatively non-movable (or only very slightly movable)]effective fixing and immobilizing of said first exterior coat 90 of said first-applied matrix means (material) 85A rotatively wiped off of the upper coated surface of the table 95A in the example shown in FIG. 4 (in multiple) and shown, individually, in FIG. 5.

As shown in FIGS. 4 and 5, the hereinbefore-mentioned first coating applicatory step and the hereinbefore-mentioned effective fixing and immobilizing step are effectively combined as shown (in multiple) in FIG. 4 and as shown (individually) in FIG. 5, with both steps being effectively accomplished by the relative rotary movement (which may mean curved, endless-loop movement or curved, non-endless-loop, but reversing, movement), best indicated at 100, of each bristle tip end 60 while it is temporarily in forced rotary wiping engagement with the semi-liquid matrix means coating 85A carried upon the upper surface of the relatively rotatable table 95A. This occurs even while the multi-bristle-brush abrasive-hone-to-be 50 is being rotated around the longitudinal axis of its centrally-positioned longitudinally-directed bristle-holding base 75 (shown in FIG. 4) in the direction shown by the circularly directed, rotation-indicating arrows 105 (although, of course, not so limited).

Figure 31:
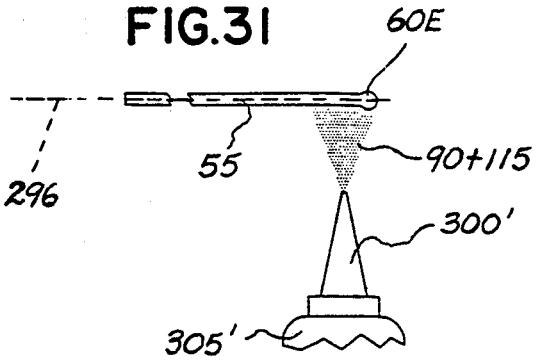
FIG. 31 shows the applicatory step of FIGS. 29 and 30 applied to the end portion of a bristle of the FIG. 11 and FIG. 13 type having an enlargement, or bead, on its outer end.
Figure 32:
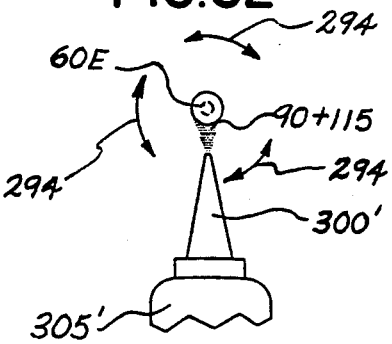
FIG. 32 is a simplified, diagrammatic end view of FIG. 31 showing the spray nozzle in slightly wider-angle-spray adjustment than shown in FIG. 30 in order to better cover the enlargement, or bead, on the outer end of the representative single bristle, etc. (very slightly enlarged in part).
Figure 33:
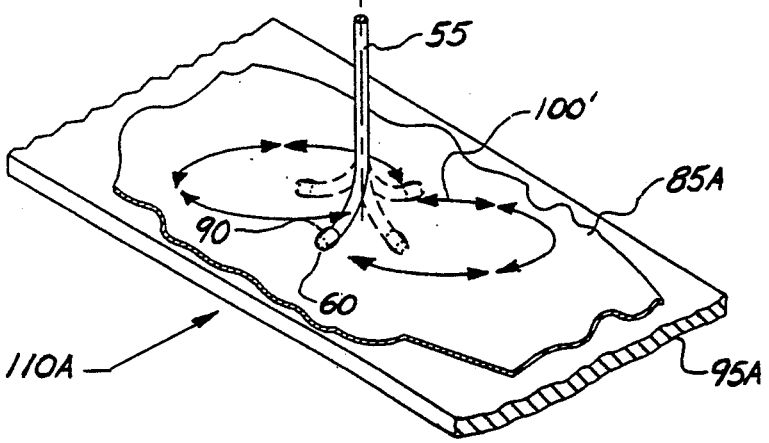
FIG. 33 is a view generally similar to FIG. 5, but illustrating another (of the many possible) relative movement effective patterns which may be employed during the "applicatory" and/or "immobilizing" steps—in this case, taking the form of a "FIG. 8" rotary movement (although, not specifically so limited).
Figure 35:
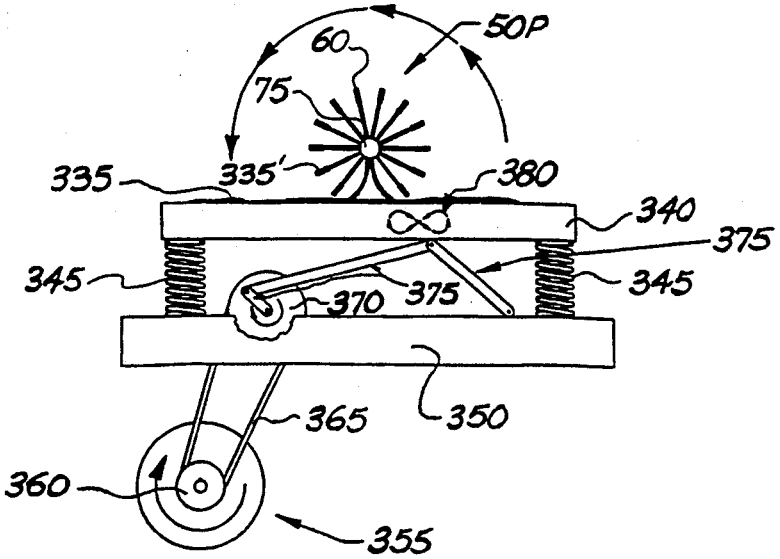
FIG. 35 is a very fragmentary, partially broken-away, skeletonized, diagrammatic, side view of another variation of the scarifying operation previously illustrated in several different forms and, in this case, it includes a movement-producing linkage (a 4-bar linkage as shown, although *not* specifically so limited) for producing a somewhat different type of relative movement than any illustrated in any of the other drawing figures and/or referred-to hereinbefore. This modified movement is suitable for scarification and/or application, etc.

The combination of the first applicatory step and the effective immobilizing step referred to hereinbefore and illustrated in FIGS. 4 and 5 may, also, be considered to effectively comprise a limited-application step and may be accomplished (or achieved) in certain other ways, such as shown in FIGS. 25–32, inclusive, for example (although, again, not specifically so limited), and/or the relative wiping movement form of said composite-two-functions method step may employ any of several different possible forms of relative rotary wiping movement, one exemplary, essentially figure-eight-simulating form of which is diagrammatically shown in FIG. 33, and another possible form of which could be similar to that diagrammatically shown in FIG. 35 (although, not limited to any of said exemplary-only variations).

The hereinbefore-described exemplary-only first applicatory step, wherein the adhesive matrix material 85A is applied to the bristle tips 60, may also be referred to as an adhesive applicatory step and the location where said adhesive applicatory step occurs may be referred to as an adhesive applicatory station, such as is generally indicated at 110A in FIG. 20, for example (although, not specifically so limited). The operation of FIG. 20 to perform (in one of many different possible ways) the basic sequence of basic method steps of the present invention will be described hereinafter.

The next step in the basic form of the novel method of the present invention is the performing of an abrasive particle, supplementary and additive applicatory step, taking the form of bringing a quantity of usually initially dry, additive, abrasive particles 115 (best shown in FIG. 6) and each already-coated bristle tip 60 (having the adhesive coat 90 thereon) into relative insertive and penetrating, temporary mating and bonding contact thereof [contact of said abrasive particles 115 with said exterior adhesive coat 90 (usually, a still semi-liquid and as-yet-uncured epoxy resin adhesive material, although not specifically so limited)] and thereby causing the effective picking-up of the abrasive particles 115 by the exterior adhesive coat 90 and the effective intermixing thereof into an effective two-phase, composite abrasive-matrix (epoxy resin adhesive) material coat 90+115. This is best shown, individually, in FIG. 6 but applies to the other coated bristle tip ends 60 (with epoxy resin coats 90) as well.

Figure 6:
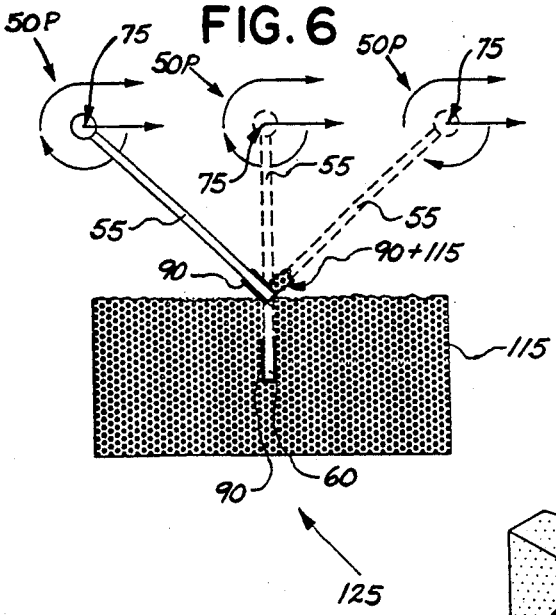
FIG. 6 is another fragmentary, partially broken-away view of the partial bristle (or filament) of FIG. 5, but shows it subsequent to FIG. 5 in the act of picking up multiple abrasive particles during the performing of what might be termed an abrasive particle, supplementary and additive applicatory step, which produces an effective two-phase, composite, coating of abrasive-matrix material.

In the specific, exemplary but non-limiting arrangement illustrated fragmentarily in FIG. 6, each of the bristle tip ends 60 is arranged so as to perform the just-described abrasive applicatory step substantially in a relative-non-lateral-displacement-causing manner such as is shown in three successive positions of the single bristle 55 shown in FIG. 6, where it is understood that the single bristle 55 is one of the many such bristles 55 carried by a bristle-holding base 75 and both rotating in a clockwise direction and moving toward the right as shown in both FIG. 4 and FIG. 20. This substantially prevents "wiping off" the epoxy resin coat 90 (with or without any of the abrasive particles adapted to be picked up thereby) which might otherwise occur—primarily, because of the normally relatively closely-packed condition of a conventional bed of abrasive particles, which would otherwise offer substantial abrasively-caused resistance to any substantial lateral movement of each bristle tip end portion 60 therethrough. Thus, virtually eliminating any such bristle tip 60 lateral movement through the closely-packed, compact, bed of abrasive particles 115 solves this problem in FIG. 6. However, it is not the only way to solve this problem and is, therefore, non-limiting. For example, an effectively fluidized bed of the abrasive particles (or an air-abrasive-particle slurry) has a greatly-reduced abrasion-caused effective resistance to lateral movement of a bristle tip end portion (epoxy-coated) therethrough and, thus, would also solve this problem. One such arrangement is partially shown in broken lines at 120 in FIG. 20, and in solid lines at 120 in FIG. 22, and will be described hereinafter. They, also, are exemplary only.

In either case, the hereinbefore-referred to abrasive applicatory step (abrasive particle applicatory step) is performed after completion of the adhesive applicatory step referred to hereinbefore, such as shown in FIG. 20 as occurring at the exemplary (but non-limiting) adhesive applicatory station indicated generally at 110A. Therefore, in said exemplary (but non-limiting) arrangement illustrated in FIG. 20, the hereinbefore-mentioned abrasive applicatory step of the novel method of the present invention is shown as being performed at an appropriate location such as that indicated generally at 125 as an abrasive particle(s) applicatory station for application per (or similar to) the showing of FIG. 6 or, optionally, per (or similar to) the showing of FIG. 22, or per any substantially equivalent (in end result) procedure for effectively causing the abrasive particles 115 to be caused to be picked up and to adhere to the previously-applied adhesive matrix coating 90 (usually, of still semi-liquid, and as-yet-uncured, epoxy resin, although not specifically so limited in all forms of the present invention).

In certain forms of the novel method of the present invention, the just-described abrasive applicatory step is repeated several times (comprising the performing of an operation-duplication step) in order to maximize the quantity of abrasive particles (particulate abrasive material) 115 picked up by the semi-liquid adhesive coating 90 before proceeding to the next step (usually the curing step, which will next be described in one exemplary, but non-limiting, form thereof) which occurs, generally, at an appropriate-flow-path-following location, such as is indicated, generally, at 130 and designated a curing station (although not specifically limited to the arrangement just described).

The next step in the basic form of the novel method of the present invention is usually performing the just-mentioned curing step (actually, a composite-material-hardening and composite-material-curing step) which, in one preferred arrangement, takes the form of subjecting each bristle tip end portion 60 which now carries (is coated with) the effective two-phase, composite abrasive-matrix material coating 90+115, to the particular required physical conditions needed for hardening and curing same, whereby to cause such hardening and curing of said composite abrasive-matrix material bristle tip coating 90+115 to a desired extent.

In one exemplary, non-limiting form of the novel method the present invention, the so-called "particular required physical conditions needed . . . " for the performance of the aforementioned curing step take the form of the application of heat of an appropriate temperature and duration (time). This is normally done at an appropriate location, such as the curing station, indicated generally at 130, where a curing oven 135 is positioned effectively in the flowpath of the multiple bristles 55 and each coated bristle tip end 60 carrying the aforementioned composite, multi-phase matrix-abrasive coating 90+115.

Figure 8:
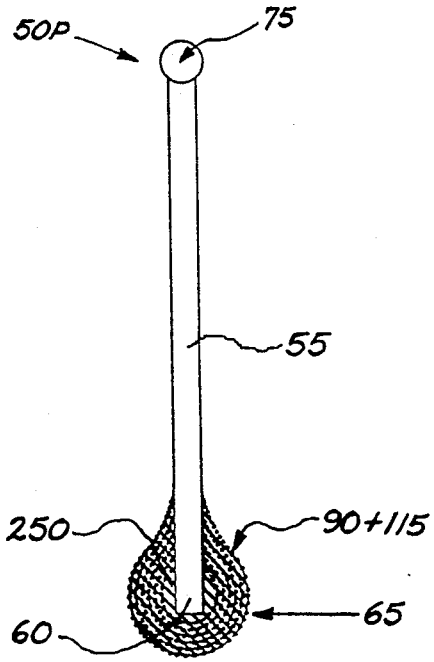
FIG. 8 shows, in fragmentary partially broken-away form, the result of the series of method steps illustrated in FIGS. 4 through 7, inclusive—all with respect to a single, fragmentarily shown, bristle portion bearing a single, fused-in-place, enlarged and virtually non-removable, abrasive globule. It, of course, should be understood that the same is true of each of the other multiple bristle portions carried by the complete prehone structure shown in FIG. 4, which will result in the production, by the novel method of the present invention, of the complete flexible abrasive hone shown in FIGS. 1 through 3.

Usually (although, not necessarily always) the next step in the novel method of the present invention is the performing of what might be termed a globule-size-increasing, multiple-lamination-producing step, which usually takes the form of repeating the sequence of preceding steps a desired number of repetitions corresponding to a desired number of layer-upon-layer laminations produced thereby and, together, comprising a desired enlarged form of abrasive globule such as the representative one shown at 65 in FIG. 8 (individually and fragmentarily) and shown in FIGS. 1–3, inclusive, (in multiple) as the active (abrasively active) parts of a complete flexible, self-centering and self-sizing abrasive hone 50.

It should be noted that the representative basic system (apparatus) shown in FIG. 20 for practicing the basic form of the novel method of the present invention and, alternatively, any or all of the several different method steps comprising the novel complete method of the present invention, can be hand-performed (wholly or partially) or can be performed aided by the use of other specific apparatuses and/or equipments, etc. Thus it is clear that the novel inventive concept of the present invention is quite properly a method or process invention, inasmuch as it is not limited to any particular apparatus.

In the non-limiting arrangement very diagrammatically shown in FIG. 20, a controllably operable drive motor 140 is coupled to (or couplable to) a dual-chain endless-loop type of conveyor 145 (the two chains of which are effectively tied together for simultaneous movement) and is adapted to controllably drive the conveyor 145 in a forward flowpath direction, such as is shown by the multiple flowpath-indicating arrows 150. Each one of the multiple hone preforms 50P (generally similar to the finished hone 50 shown in FIGS. 1–3, inclusive, except for the enlarged abrasive globules 65 which are not yet present) is rotatively attached across (and to) the two chains of the conveyor 145 by (controllably releasable when desired) half-bearing straps 155 extending over the central longitudinal bristle-holding base (or stem) 75 of hone preform 50P, and fastened to the two chains of the conveyor 145 near to opposite ends of the preform's stem 75 in a manner which allows said stem 75 (and the entire corresponding hone preform 50P) to rotate around the transversely-directed imaginary axis of said stem 75 as a result of torque imparted thereto by the frictional rolling engagement of an idler disc, or roller, 160 fixedly carried by said stem 75 and having its outer periphery positioned for frictional engagement with underlying adhesive applicatory station's table (or platform) 95A (previously shown in FIG. 4), which is the relatively rotatable table 95A bearing the adhesive matrix means 85A (usually, a semi-liquid plastic epoxy resin material, although not so limited). Thus the preform-rotating movement previously referred to as being shown by the directional arrows 105 of FIG. 4 is produced as long as the friction roller 160 is in contact with the upper surface of the underlying table 95A as is clearly shown in FIG. 20.

The previously-mentioned relative rotary movement of the table 95A relative to the hone preform 50P, as indicated by the curvedly-directed arrows 100 in FIG. 4, is accomplished, in FIG. 20, by controllably and correlatedly imparting two different, mutually perpendicular, horizontal reciprocating forces (and consequent movements) to the entire underlying table 95A as indicated by the two double-ended arrows 165 and 170 (both in parallel horizontal planes and perpendicular to each other) which, together, combine to form the relative rotary (meaning, curved) movement previously mentioned and indicated, in one non-limiting form, at 100 in FIG. 4.

In the example illustrated diagrammatically and fragmentarily in FIG. 20, said two horizontal-planes reciprocating forces (and consequent movements) indicated by the two double-ended arrows 165 and 170 are effectively provided by two corresponding reversing (reciprocating) actuators, indicated very diagrammatically at 175A and 180A, respectively, which may comprise pressurized-fluid-operated, double-action, hydraulic or pneumatic cylinder type actuators, although not specifically so limited. It should be understood that the two actuators 175A and 180A are shown very diagrammatically inasmuch as they are well known in the art and that they are adapted to be provided with any well-known type of input and output ducts (usually, flexible) and appropriate valving, etc. *all* connectable to any well-known source of pressurized fluid (usually, through a main control and correlation center—also, well known in the art—for controlling the timing, duration, and amplitude and direction-of-pressure of such pressurized fluid to the different actuators, the cycling or reciprocation thereof and/or the relationships therebetween). The ducting, valving, said main control and correlation center and the source of pressurized fluid are all not specifically shown inasmuch as such arrangements are well known in the art and inasmuch as such do not touch upon the real inventive concept of the present invention.

The upper platform 185A of FIG. 20 is transversely horizontally slidably mounted upon a pair of transversely directed (in a horizontal plane) mounting rails 190A, which are, in turn, fixed to the upper surface of a lower platform 195A which is longitudinally horizontally slidably mounted upon a second pair of (usually fixed) mounting rails 200A, this time longitudinally directed (in a second horizontal plane just below the first-mentioned horizontal plane). The mounting rails 200A are usually adapted to be mounted upon an appropriate underlying supporting base [not shown inasmuch as such a supporting base (structure) is well-known in the art and does not touch upon the real inventive concept of the novel method of the present invention].

It should be noted that, in the so-called " . . . relative rotary (or rotating) movement . . . " of the table 95A relative to the hone preform 50P (one exemplary—and somewhat idealized—form of which is indicated diagrammatically by the curved arrows 100 in FIG. 4 and in FIG. 20A, which would, of course, be modified somewhat by movement of the conveyor 145), the meaning of the words " . . . rotary . . . " and " . . . rotating . . . " is to be very, very broadly construed to mean virtually any type of curved (non-straight) relative movement involving (and/or including) relative movement of a repetitive (or cycling) nature where relative displacement occurs on each side of an intermediate effective null (zero) lateral relative displacement location. This, of course, includes relative movement of generally circular, oval, elliptical or other closed-loop shapes, one exemplary, but non-limiting form of which is illustrated at 100 in FIGS. 4 and 20A; but it also includes non-closed-loop configurations, one exemplary but non-limiting form of which is diagrammatically shown at 101 in FIG. 20B, which is generally the type of relative movement which would be produced between the adhesive-coated table 95A and each bristle tip 60 of the hone perform 50P if the longitudinal reciprocating force 165 is eliminated entirely—such as by eliminating those optional portions of the apparatus located at the adhesive applicatory station 110A and including the lower platform 195A, the lower pair of rails 200A and the lower reciprocating actuator 175A. The two different kinds of relative movement (and arrangements for producing same) are shown to illustrate the great variability of said relative movement which can be employed in the hereinbefore-mentioned first applicatory step (or any subsequent and/or later-described preceding step, or steps) and/or can be employed in the hereinbefore-mentioned immobilizing step, irrespective of whether said two steps are effectively combined or are completely separately performed.

It should also be noted that in the novel method of the present invention, as described up to this point (and as correspondingly illustrated up to this point), the mounting of each bristle 55 is such that it (the bristle 55) is not free for rotation around its own longitudinal bristle axis (imaginary) while the bristle tip 60 is being effectively wipingly moved along and through the semi-liquid adhesive matrix material 85A coated upon the top surface of the relatively movable table 95A—somewhat like the simplified diagrammatic (but non-limiting) showing of said relative movement with respect to a single representative bristle fragmentarily shown at 55 in FIG. 5, for example. This type of relative movement while the bristle tip is forcibly biased against the coated surface of the relatively movable table will insure that the bristle tip must turn over so all outer surface portions of just the laterally bent bristle tip 60 will contact the coated upper surface of the relatively movable table 95A for wipingly performing both the applicatory step and the so-called immobilizing step.

The position of the shaft of each bristle 55 during the relative movement of the bristle tip 60 relative to the coated upper surface of the relatively movable table 95A, as shown in FIG. 5 for example, usually assumes a somewhat more than shown curvedly angular, downwardly outwardly diverging (or outwardly displaced) configuration such that a complete circular relative movement would effectively define a surface somewhat resembling a modified inverted cone having a downwardly diverging non-straight angular sidewall which would appear, in an imaginary vertical sectional view of the inverted modified cone, to be outwardly effectively concave to an extent determined by the magnitude of the relative displacement, the effective stiffness (and length) of the bristle 55, and the biasing force exerted between the bristle 55 and the coated upper surface of the relatively movable table.

Of course, in all of the foregoing description of said relative applicatory and/or wiping movement (motion) ("rotary" or "rotating" movement in the broad generic sense effectively defined in this present specification) it should be understood that said relative movement may be provided virtually entirely by movement of the table 95A, virtually entirely by movement of each such bristle 55 (and each such bristle tip 60 carried thereby), or by movement of each of same, inasmuch as all three kinds of movement result in "relative movement" within the meaning and scope of the language defining the novel method of the present invention, wherein this feature (method step) is a major part of the novel inventive concept of the present invention.

It is also possible for the aforesaid "relative movement" ("rotation" or other "curved" movement, construed in a broad sense as effectively defined herein, or similar, or effectively equivalent, thereto) involved in said applicatory and/or effective immobilizing step (or steps) to comprise a "modified relative movement" and to include relative rotation of each bristle 55 (and, especially, each bristle tip 60 carried thereby) around an imaginary longitudinal axis along the length direction of the bristle 55 with respect to the adhesive material 85A [either while said adhesive material 85A is carried as a semi-liquid coating on the table 95A (or equivalent) or is otherwise adjacent to the bristle tip 60 and is effectively applied (in a controlled and limited fashion) to the relatively rotating bristle tip 60]. Of course, the absolute (rotating) movement in the aforesaid "modified relative movement" may be provided virtually entirely by "rotation" of the bristle 55 around its imaginary longitudinal axis, or virtually entirely by "rotation" of the adhesive material 85A (or an applicatory source thereof) around the bristle tip 60, or by movement of each of same, inasmuch as all three kinds of movement result in "relative movement" within the meaning and scope of the language defining the novel method of the present invention. For example, consider FIGS. 25 and 26, FIGS. 27 and 28, FIGS. 29 and 30, and FIGS. 31 and 32—all of which show (very diagrammatically) certain representative (but non-limiting) forms of such "modified relative movement".

The "biasing force" previously mentioned as part of the applicatory and/or immobilizing step performed at station 110A in FIG. 20 is provided by making the table 95A height-adjustable (under the action of appropriate upward biasing force, which is also controllably reversible when desired). In the FIG. 20 example illustrated, this is accomplished by pivotally attaching a scissors mechanism (sometimes known as a scissors jack, or actuator), indicated generally at 205A between the platform 185A and the table 95A; and by, further, pivotally connecting a double-action actuator 210A to a linkage or coupling bar 215A which is attached to the scissors jack 205A for controllably operating same and correspondingly raising or lowering the table 95A as desired. Normally, when the adhesive matrix coating 85A carried by the upper surface of the table 95A is to be applied to each bristle tip 60 of a plurality thereof carried by each hone preform 50P, the table is raised by the scissors jack 205A and the actuator 210A until the downwardly directed bristles 55 are partially bent by the forcible bias imparted thereto by the forced raising of the table 95A as is shown (in multiple) in FIG. 4 and (individually) in FIG. 5.

In the example illustrated in FIG. 20, the double-action actuator 210A is shown as comprising a double-action, fluid-pressure-operated hydraulic or pneumatic cylinder of a well-known-in-the-art type (although not specifically so limited) and is shown very diagrammatically and is adapted to be provided with any well known type of input and output ducts (usually, flexible) and appropriate valving, etc., all connectable to any well-known source of pressurized fluid, etc. and, usually, to a main control and correlation center—also well known in the art—for controlling the operation of the scissors jack actuator 210A, as desired or needed for proper operation of station 110A, etc. Said main control and correlation center may be the same as (or comprise a part of) the main control and correlation center previously mentioned for controlling the previously described two actuators 175A and 185A, etc., and none of the ducting, valving, main control and correlation center and the source of pressurized fluid are specifically shown inasmuch as such arrangements are well known in the art and inasmuch as such do not touch upon the real inventive concept of the present invention.

The rate of forward rotary (or rotative) movement of the entire hone preform 50P is determined by the diameter of the friction roller 160 and it may be made size-adjustable by providing for the interchanging of different friction rollers (and/or engaging surfaces) of different effective frictional engagement diameters; or an axially shiftable conical friction roller having a varying exterior diameter along the axial length thereof (or effective equivalent) may be employed for this purpose.

After completion of said first coating applicatory (and immobilizing) step (a combination adhesive-liquid-applying-and-immobilizing step, as illustrated diagrammatically and fragmentarily in FIGS. 4, 5 and 20), while the hone preform 50P is located at (or in) the adhesive applicatory station 110A of FIG. 20 (and is moving therethrough as a result of the transporting action of the conveyor 145), the preform 50P (and each bristle tip 60 of each bristle 55 thereof) is ready to be subjected to (and is subjected to) the next method step of the novel method of the present invention comprising the previously-mentioned abrasive particle(s) additive applicatory step, which is performed while the hone preform is in the location of, and is adapted to be moved by the conveyor 145 through, the abrasive particles applicatory station 125 of FIG. 20. This is shown with respect to the entire hone preform 50P in FIG. 20 and is shown, very diagrammatically, in FIG. 6 with respect to a single representative bristle 55 (which, however, is shown in several different movement positions roughly and diagrammatically representing what happens to each bristle tip 60 as the entire hone preform 50P of FIG. 20 moves through the abrasive particles applicatory station 125).

As best shown in FIG. 6, each adhesive-coated bristle tip end 60 initially enters the bed of abrasive particles 115 (as shown at the left of FIG. 6) bearing (or carrying) none of the abrasive particles 115 (usually, "Carborundum", silicon carbide, or the like), but soon picks up (adhesively) a substantial quantity of the abrasive particles on (and in) the still-liquid or semi-liquid adhesive coating 90 (usually epoxy resin, although not so limited in all forms of the invention) so the bristle tip 60 effectively carries the two-phase composite plastic-matrix-abrasive-particle material 90+115 when it emerges from the bed of abrasive particles 115 (as shown at the right of FIG. 6). This can be accentuated and the amount of the abrasive particles 115 picked up can be increased by increasing the duration time of the intimate contact between the bed of abrasive particles 115 and the adhesive-coated bristle tip end 60, which may be accomplished in a number of different ways, such as by temporarily slowing (or even stopping) the advancing movement of the conveyor 145, or by effectively repeating the operation, or by increasing the number of such abrasive particle applicatory stations, etc., or otherwise increasing (and/or effectively enhancing) the intimate contact and "pick-up" operation just described, etc.

Inasmuch as the adhesive coating 90 is still in a semi-liquid, or liquid, state during the abrasive particle(s) applicatory operation (or step) shown in process with respect to a single representative one of the plurality of bristles 55 of the hone preform 50P, it is important to avoid (or to at least greatly minimize) any tendency of the bed of abrasive particles 115 to, in effect, frictionally "wipe off" said liquid, or semi-liquid adhesive coating 90 (usually uncured epoxy resin) and/or any already picked-up abrasive particles 115 (any of the composite, two-phase adhesive-abrasive material 90+115) from the bristle tip end 60. Therefore, in the example illustrated in FIG. 6, any relative lateral movement (or motion) of the compositely coated bristle tip end 60 through the bed of abrasive particles 115 is to be avoided, or minimized as much as possible, by effectively bringing it (the compositely coated bristle tip 60 and the bed of abrasive particles of finely-divided particulate abrasive material 115) into relative-non-lateral-displacement-causing (relatively) insertive and penetrating, temporary, mating and bonding contact, one representative form of which is shown diagrammatically in FIG. 6. As shown in said FIG. 6, the upper portion of the representative single bristle 55 is being moved to the right by the conveyor 145 of FIG. 20 to an extent sufficient to substantially balance out (and effectively neutralize) the movement of the bristle tip 60 toward the left, as shown in FIG. 6, so said bristle tip 60 moves substantially neither to the right nor toward the left in FIG. 6, but merely downwardly, and immerses itself in the multiple abrasive particles 115 and then removes itself therefrom with very little (or virtually no) lateral movement thereof, as is clearly shown in the three-sequential-positions showing of a single bristle 55 in FIG. 6.

However, while FIG. 6 shows one representative way of minimizing the aforementioned bristle tip "wipe-off", various other method steps, within the broad scope of the present invention, may be employed for this purpose and are intended to be included and comprehended herein. One such is fragmentarily and diagrammatically shown partially, in broken lines, at 120 in FIG. 20 and is individually shown fragmentarily, in solid lines, at 120 in FIG. 22, wherein it effectively comprises the "fluidizing" of the abrasive particles (pumping a fluid such as air, or the like, under pressure through a bed 115F of such abrasive particles 115) so that the abrasive particles 115 are separated sufficiently from one another to greatly reduce any lateral frictional resistance to lateral displacement of the compositely-coated bristle tip 60 through the now widely-spaced-apart individual abrasive particles 115 forming the abrasive particle bed 115F. This "fluidizing" effect is maximized in the upper portions thereof.

In the non-limiting example illustrated (best shown in FIG. 22), the above-mentioned "fluidizing" action is achieved by providing an open-topped container 220 which has a porous diffuser plate, or filter means, or effective screen or sieve 225 having multiple through-holes (or apertures) 230 which have effective openings (voids) smaller in effective size (cross-sections) than the exterior size of the smallest of the abrasive particles 115, but which are readily pervious to pressurized air, which is forced upwardly therethrough from a lower manifold 235, having pressurized air pumped thereinto, through a flexible input duct 240, from any conventional source of pressurized air, such as that indicated diagrammatically at 245, for example (such as a motor-driven air compressor, or pump, or the equivalent—not shown since such are well-known in the art).

Figure 7:
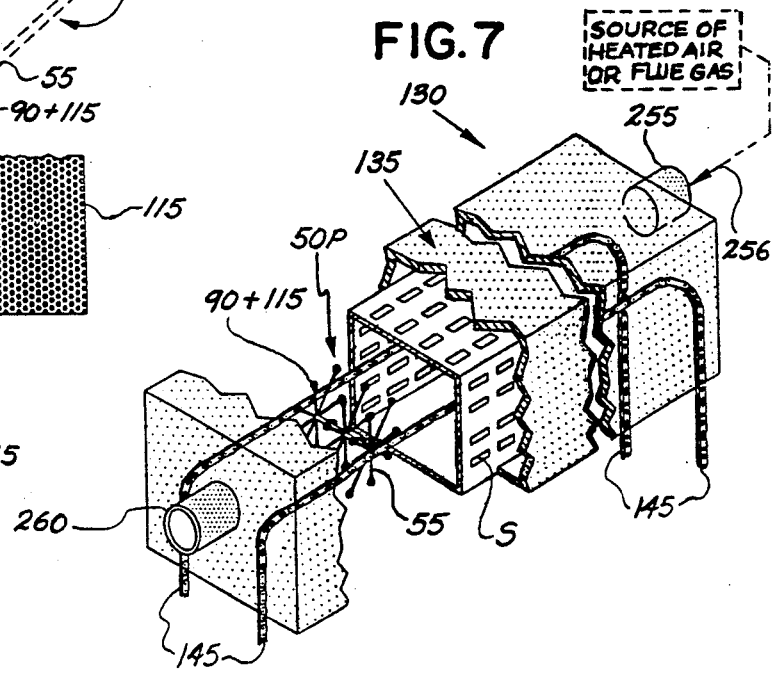
FIG. 7 shows, in a fragmentary, very diagrammatic, way a later composite-material-hardening and composite-material-curing step, which results in an enlarged, effectively and virtually non-removably fused-in-place abrasive globule firmly mounted on each bristle tip end portion, as shown fragmentarily in FIG. 8 after multiple repetitions of the steps shown in FIGS. 5 and 6.

The next method step in the basic form of the novel method of the present invention, (one representative form of which is diagrammatically shown in FIG. 20) is the performing of a composite-material-hardening and composite-material curing step (or operation), one version of which is performed at curing station 130 shown in FIG. 20 and, also, in FIG. 7, where a curing chamber (or oven) 135 is positioned to receive the conveyor 145 in one end thereof, extending therethru, and continuing on out of the other end of said curing chamber (or oven) 135 so the hone preforms 50P can pass into—and through—and out of the curing chamber to effectively cure and harden the composite, multi-phase adhesive-abrasive material 90+115 to a desired, optimum extent. This will produce a one-lamina or one-coat abrasive globule similar to that shown at the innermost lamina or coat layer indicated at 250 on FIG. 8 (which shows a multiple-layer laminated construction of the greatly enlarged globule 65 of FIG. 8). A duplication (or repetition) of the foregoing steps will result in producing an enlarged abrasive globule similar to those shown at 65 in FIGS. 1-3, inclusive, and of virtually any desired size (within certain limits) depending, primarily, upon the number of repetitions of said step, which can be said to comprise the performing of a globule-size-increasing, multiple-lamination-producing step, and further depending upon bristle-tip-size and/or abrasive-particle-size, and certain other characteristics, variables and/or parameters, etc.

In the representative curing chamber 135 shown in FIGS. 20 and 7, the "physical condition" which effects the so-called "curing" is heat—and it is provided by convection—the passage of heated air over and around the multiple hone preforms 50P (and each cf the plurality of bristles 55 thereof) which are to be cured. This may be done by way of multiple oven ingress slots S and by way of heated air hollow coupling sleeves 255 and 260 which are adapted to be coupled into a heated air circulating system having a source of heated air (or hot flue gas, or equivalent 256)—all not shown in detail since such arrangements are well-known in the art. Also, various other types of curing (or hardening) may be employed within the broad scope of the present invention, such as radiant heat (instead of convection heat), ultra-violet-radiation (or other cure-effecting radiation, or other effective equivalent "curing" procedure, or procedures). Two such exemplary, but non-limiting variations are shown generally at 135R in FIG. 23 and at 135UV in FIG. 24, etc.

Figure 23:
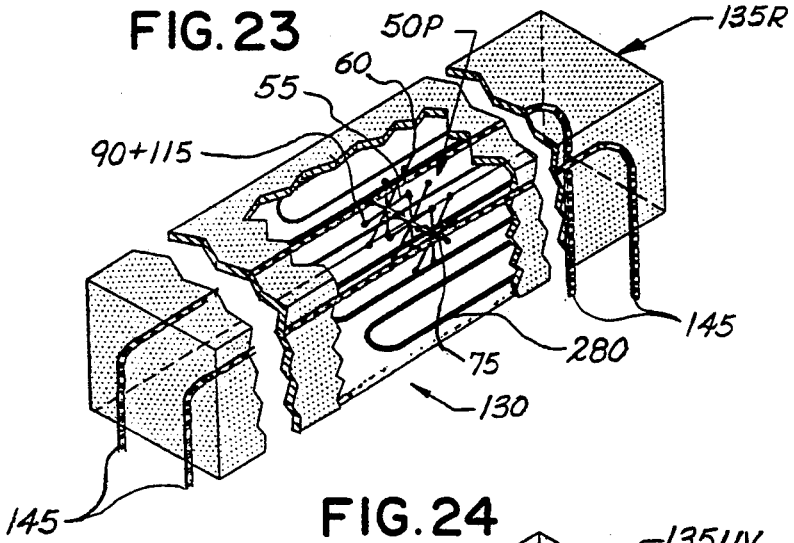
FIG. 23 illustrates (fragmentarily and diagrammatically) one exemplary variation of the "hardening" and "curing" step originally shown in FIG. 7, from the application of "curing" heat by a form of convection-heat-applying oven to the application of such "curing" heat by a form of radiant-heat-applying oven.

As shown in FIG. 23, the convection type of heat source (flowing hot air or hot flue gas, etc.) 256 of FIG. 7 is replaced by an appropriate source of radiant heat, such as the non-limiting heating element means 280, which may be of any suitable type—usually, (1) an electrically energizable length of heat-resistant, electrically-conductive heating element material having suitable electrical resistivity characteristics, such as a "Nichrome" (nickel-chromium alloy) coil, or the like; or (2) a length of "low-temperature" heating element material, such as a heat-resistant matrix (carrier) of heat-resistant rubber or plastic material, or equivalent [usually of relatively low electrical conductivity and often flexible, (although not so limited)], containing (or effectively carrying) a plurality of heat-resistant electric-current-carrier particles (or elements)—often carbon particles—so arranged with respect to each other and with respect to the low electrical conductivity matrix (carrier) material as to comprise a "low-temperature" heating element adapted to operate at a lower surface temperature than a "Nichrome" coil, or the like, but to still radiate a considerable absolute quantity (B.T.U.s) of heat because of the usual large heat-radiating surface thereof; (3) or the type generally used in electric stoves, or the like, where multiple packed-together particles of a material (having an exceptionally high ratio of thermal conductivity to electrical conductivity) effectively form an efficient high-wattage-output electric heating element and radiant energy (heat) source 280.

Figure 24:
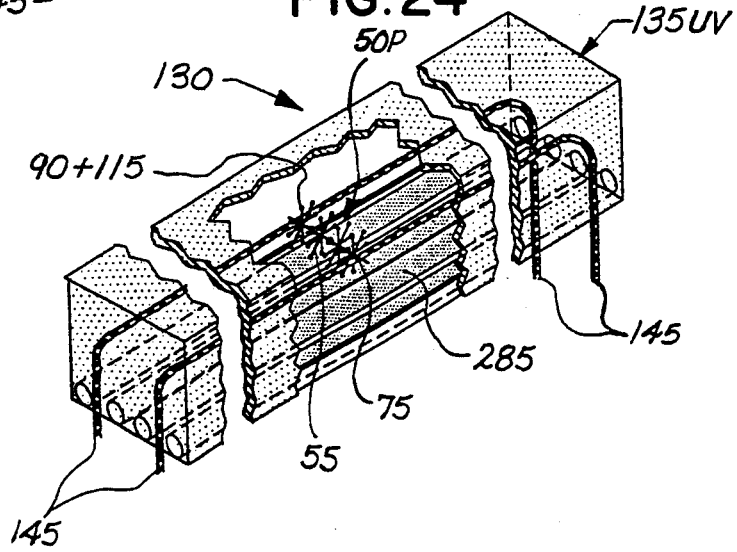
FIG. 24 illustrates a further exemplary variation of the "hardening" and "curing" step, wherein radiation is again used for the "hardening" and/or "curing" operation—but, in this case, is at the opposite end of the spectrum; the ultra violet radiation end thereof. This requires that the adhesive plastic matrix material be one of such materials sensitive to, responsive to, and capable of being cured by exposure to ultra, violet radiation, etc. (or to any other desired band of "curing" radiation).

As shown in FIG. 24, the source of "curing" energy is modified to comprise an ultra-violet radiation source 285, which may comprise discharge-type lamp means (usually quartz-glass tubing containing spaced opposite-polarity electrodes separated by mercury vapor, although not so limited). The matrix material 90 (epoxy resin, in the heat-cured first version already described, although not so limited) must be altered or changed when the ultra violet curing step illustrated diagrammatically in FIG. 24 is to be employed. In this latter case, an ultra-violet-sensitive or ultra-violet-responsive curable plastic resin (or composite) must be used to form the matrix material coating portion 90 of the composite multi-phase adhesive-abrasive coating 90+115 on the tip end 60 of each bristle of each hone preform 50P which is to be cured by controlled exposure to ultra violet radiation in the modified curing chamber fragmentarily illustrated at 135 UV in FIG. 24.

It should be noted that in the exemplary, but non-limiting, showing of FIG. 20 the bed of abrasive particles 115 is supported upon the top surface of, and is carried by, an effective abrasive table 380, which is usually provided with upstanding side (retaining) walls 385 adapted to help retain (or contain) the quantity of abrasive particles 115 in place. In certain non-limiting arrangements, the effective abrasive table 380 may, also, be provided with end wall means 390, which may be partially cut-away at top central hone-preform-entry locations 395 thereof to facilitate passage therethru for the hone preforms 50P, or which may be provided with a flexible, deflectable entry gate at said hone-preform-entry locations 395.

In lieu of the end wall partial cut-away portions (or the alternative flexible, deflectable entry gate) at 395, the effective abrasive table 380 (which is height-adjustable in essentially the same manner as, and by way of essentially the same type of apparatus as that previously illustrated and described in detail with reference to the adhesive applicatory station table 95A) is arranged (by pre-programming its height-adjustable actuator **205*a*) to initially position the abrasive table 380 low enough to allow a hone preform 50P which is approaching the abrasive particles applicatory station (actually, being carried there by the conveyor 145) to pass over the end wall 390, after which the abrasive table is moved upwardly (by an appropriate upward height-adjustment action performed by said abrasive table actuator 205*a* to exactly the proper height location for proper engagement of each epoxy-coated bristle tip 60 with the bed of abrasive particles 115 in the general manner shown with respect to one representative individual bristle 55 in FIG. 6 (or, alternatively, in the manner shown in FIG. 22). The same abrasive-table height-adjustable actuator 205*a* is, also, pre-programmed to perform essentially a reverse height-adjusting action when the conveyor 145 moves the now abrasive-particle-coated hone preform to the exit end wall 390 carried by the exit end of the abrasive table 380, at which time the abrasive-table height-adjustable actuator 205*a* lowers said abrasive table 380 back to its initial lower-height position, which is low enough to allow the now abrasive-particle-coated hone preform 50P to clear and pass over the exit end wall 390**.

Incidentally, it should be noted that the similar actuator 205A for the adhesive applicatory station's table 95A may be pre-programmed in a manner generally similar to that just described immediately-hereinbefore for the abrasive-table actuator **205*a* in order to provide the proper biasing force against each bristle tip end 60 during the wiping-action relative-movement step best shown in FIG. 5—that is, while each hone preform 50 is being carried through the adhesive applicatory station 110A**. However, the invention is in no way limited by (or to) that particular exemplary way of providing the vertical bristle-tip biasing force. It may be manually provided, or it may be provided by other effectively equivalent (as to end-result achieved) apparatus and/or equipment, etc.

In the example illustrated in FIG. 20, the abrasive-table height-adjusting actuator means **205*a* takes the form of a scissors mechanism (sometimes known as a scissors jack, or actuator) pivotally attached between the effective abrasive table 380 and an underlying, downwardly-spaced platform 185*a*; and, further, includes a double-action, fluid-pressure-operated (hydraulic or pneumatic) so-called "cylinder" 210*a* of a well-known-in-the-art type (although not so limited) virtually identical to the previously illustrated and described adhesive-table actuator cylinder 210A and, similarly provided with the same type of connection, control, correlation, and/or fluid-power-supplying accessory equipment and/or apparatus as that previously referred to as being adapted to be provided for (and with) said first-mentioned and first-described adhesive-table actuator cylinder 210A, and, therefore, not again described here. The cylinder 210*a* is pivotally connected to a coupling or linkage bar 215*a* which is attached to the scissors jack 205*a* for controllably operating same and correspondingly raising and lowering the abrasive table 380 as desired—all similar to the previously described mode of operation of the adhesive applicatory station's scissors jack 205A and actuator cylinder 210A**. Therefore, these two height-adjustment can be said to be both physically and functionally virtually identical (or similar) and no additional detailed description of the second of same is thought to be necessary, or even desirable, because such would quite obviously be redundant.

Figure 9:
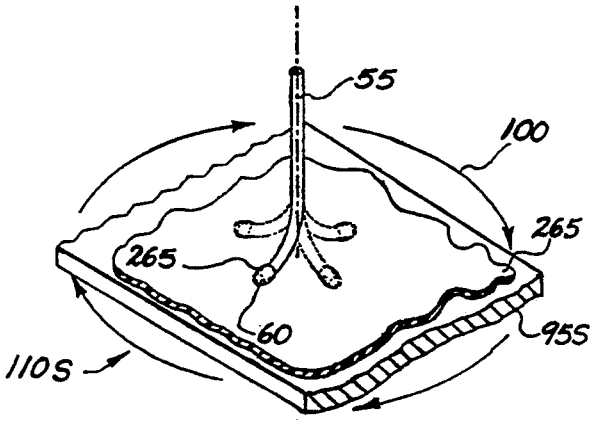
FIG. 9 is a fragmentary perspective view generally similar to FIG. 5, but shows a slight variation in the method of the present invention including two additional steps (the first of which is shown in FIG. 9) which are to be performed before the first coating applicatory step shown in FIG. 5, and which comprises the pre-coating step of effectively preparing (treating) each bristle tip end portion in a manner which will effectively increase the strength of the junction between the material of the bristle tip end portion (often nylon) and the material comprising the first coat, or lamina (usually, an epoxy resin plastic), to be subsequently applied, as shown in FIG. 5.
Figure 15:
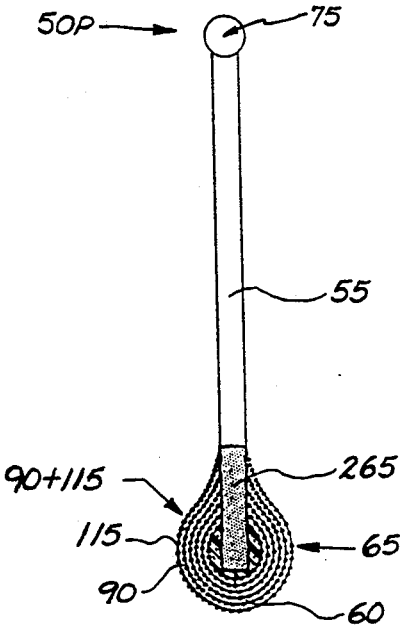
FIG. 15 is another view very much like FIG. 8, but shows a different-from-FIG. 14 modified, and junction-strength-increased mounting of the enlarged abrasive globule on the bristle tip end, produced in another representative additional "scarifying" (effective roughening) method step such as is shown in FIG. 9, for example (although, not specifically so limited in all forms of the invention).
Figures 20C, 21:
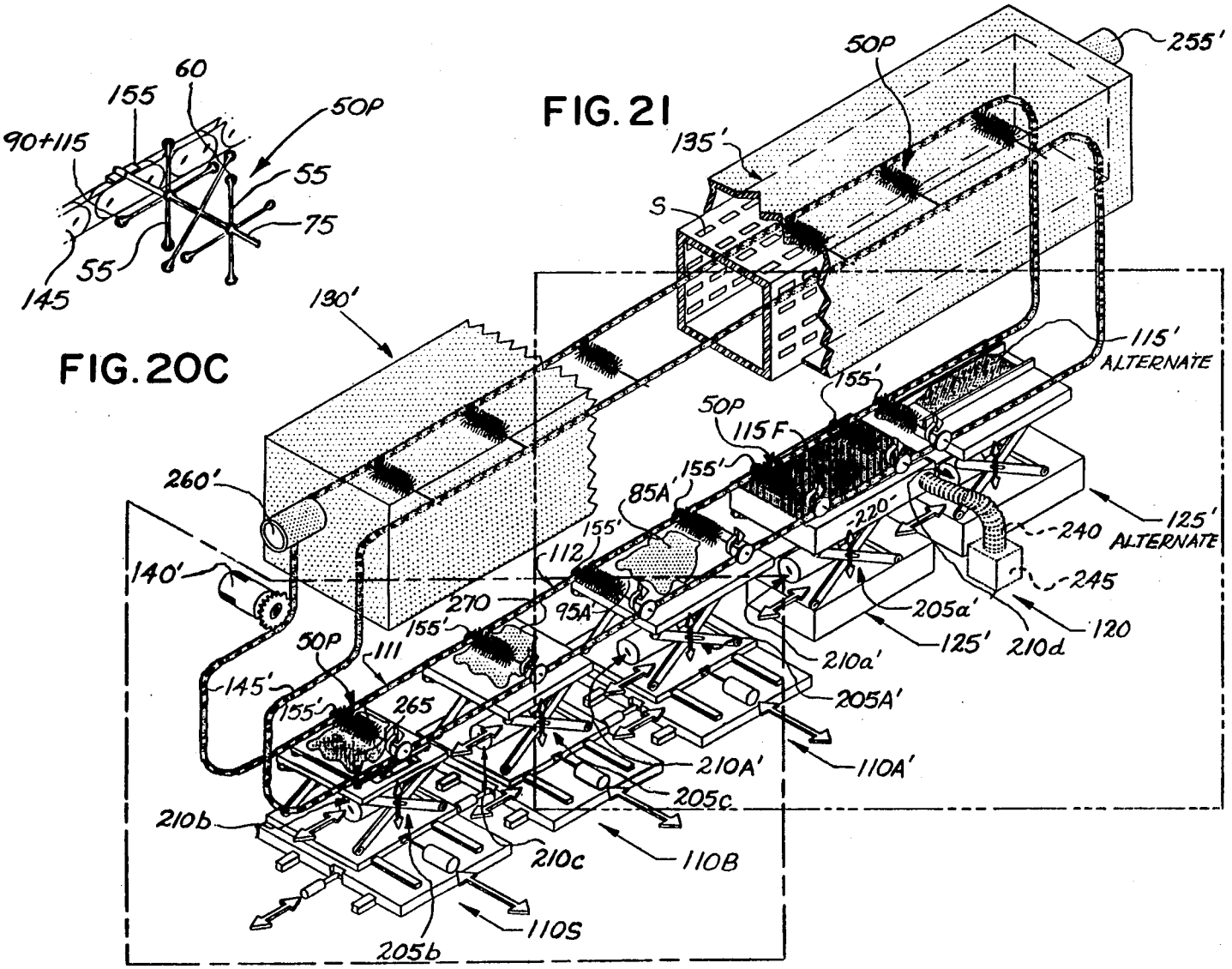
FIG. 20C is a fragmentary enlargement of that portion of FIG. 20 positioned within the circle indicated by the arrow 20C in FIG. 20.
FIG. 21 is another overall system (method) view generally similar to FIG. 20, but merely effectively extending the overall system (method) beyond that shown in FIG. 20 to include two additional method steps (both, or either of the two, as desired) plus a duplication (or multiplication) of the abrasive applicatory step (one or more times, as desired).

FIGS. 9 and 15 are generally similar, respectively, to previously described earlier drawing FIGS. 5 and 8, respectively, but illustrate the inclusion of an additional step in the novel method of the present invention—a so-called scarification step, which can be performed manually by the use of the apparatus shown generally in a so-called scarification station, indicated generally at 110S in FIG. 21, or can be performed by other functionally similar equipment and/or apparatus.

The purpose of the above-mentioned scarification step is to substantially increase the strength of the junction of an entire finished abrasive globule 65 with the exterior wall of a bristle tip 60 beyond that which would normally (or otherwise) occur. This is particularly important when the bristles 55 (and, of course, the tips 60 thereof) are made of nylon plastic material which makes a very good flexible bristle, but is characterized by having a very smooth, almost wax-like outer surface which normally does not adhere (or bond) very strongly to certain of the epoxy resins which may be used for the adhesive matrix coating 90 (or multiple layers—or lamina—thereof). This adhesion problem can be solved by treating the surface of each bristle end in a manner which will effectively scarify (soften, roughen and/or render more porous) the exterior surface of each bristle tip 60 so the next outwardly adjacent layer of adhesive matrix material (coating) 30 (usually, an epoxy resin) can adhere to the inwardly adjacent "scarified" surface of the nylon bristle tip 60 much more strongly than would otherwise be the case. The scarification operation is preferably performed in a manner quite similar to the previously-described first coating applicatory step (the adhesive applicatory step) shown individually, in FIG. 5 and shown in multiple in FIG. 20 at adhesive application station 110A, except for the fact that the scarification material 265 is substituted for the epoxy resin adhesive plastic matrix material shown at 85A as a coating upon the table 95A in FIGS. 5 and 20 and shown at 90 after the wiping-movement application thereof to each bristle tip 60. These two substituted showings are set forth in FIGS. 9 and 21, and will be not be described again in detail because it would obviously be redundant to do so.

Figures 20A, 20B, 20E, 20F:
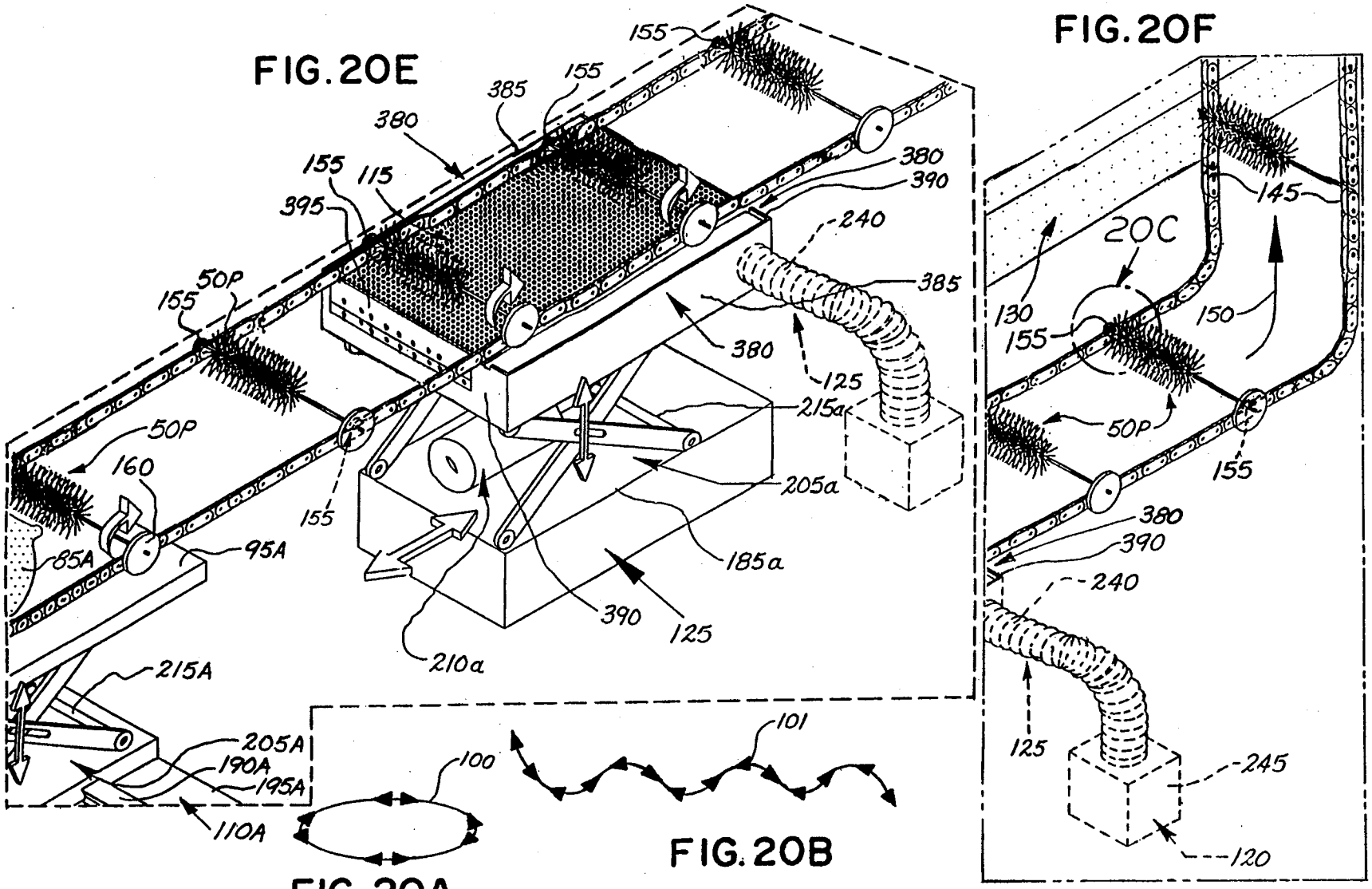
FIG. 20A and FIG. 20B show different non-limiting types of the "relative curved wiping movement" (reversing relative displacement from an intermediate point), etc.
FIG. 20E is a fragmentary enlargement of the lower middle portion of FIG. 20—that portion located immediately to the right of FIG. 20D.
FIG. 20F is a fragmentary enlargement of the lower right corner portion of FIG. 20—that portion located immediately to the right of FIG. 20E.

FIG. 15 shows the multi-layer (many laminations) enlarged abrasive globule 65 formed by repeating the steps and is similar to the previously described multiple-lamina enlarged abrasive globule, as shown at 65 in FIG. 8, but additionally including the inner scarification layer 265, which is preferably applied "thinly" to the bristle tip 60 only by the novel "wiping-application" movement of the present invention (two representative forms of which are shown at 100 in FIG. 20A and at 101 in FIG. 20B, although other forms of application may be substituted therefor in certain forms of the present invention.

While the scarifying step just described can be performed manually, it can also be performed by properly using any of a variety of different machines and/or equipments, one exemplary, non-limiting form of which is illustrated in FIG. 21 where, one exemplary form of the complete scarification apparatus is located in the first processing section 110S of a multi-station (effectively extended) machine, shown in FIG. 21, which comprises an extended version of the already described basic machine (for performing the basic method steps of the present invention) shown in FIG. 20. Therefore parts shown in FIG. 21 which correspond to previously identified and/or described parts shown in FIG. 20, are designated by similar reference numerals and/or letters and/or markings, primed however and not again described in specific detail because it would be redundant to do so.

However, FIG. 21 also shows three additional stations (beyond, or in excess of, the two duplicated stations 110A' and 125'), and two of these three additional stations, 110S, 110B and 125' (alternate), are almost (but not quite) duplicates of previously described adhesive applicatory station 110A of FIG. 20. This is true in the case of two of the new FIG. 21 stations, 110S (the scarifying station referred to immediately hereinbefore) and 110B (an interjunctionary bridging station, which will be described hereinafter). The third additional station 125' (alternate) is almost (but not quite) a duplicate of previously described abrasive applicatory station 125 of FIG. 20. Therefore, in the showing of new FIG. 21, as compared to the showing of previously described FIG. 20, as previously mentioned, only the similar parts are identified by the same (but primed) reference numerals designating parts which need not again be described, while changes are otherwise specifically noted and described immediately hereinafter. In the case of the first one (110S) of said three new stations shown in FIG. 21 (which is optional and not always present in all forms of the invention), the capital letter "S" indicates that it is a scarification (or scarifying) station, as distinguished from its otherwise simlarly constructed predecessor station 110A of prior FIG. 20, where the capital letter "A" indicates that it is an adhesive applicatory station. The only other change is the changing of the adhesive plastic matrix coating applied by said adhesive applicatory station 110A of prior FIG. 20 to the scarifying (scarification) material 265 of FIG. 21 (also shown in FIG. 9 and FIG. 15) which scarifying material 265 will be described in greater detail subsequently.

In the case of the second one (110B) of said three new stations shown in FIG. 21 (which, also, is optional and not always present in all forms of the invention), the capital letter "B" indicates that it is a bridging station, as distinguished from its otherwise similarly constructed predecessor, adhesive applicatory station 110A of prior FIG. 20. The only other change is the changing of the adhesive plastic matrix coating applied by said adhesive applicatory station 110A of prior FIG. 20 to the bridging (interjunctionary bridging) material 270 of FIG. 21 (also shown in FIG. 10 and FIG. 14), which bridging material 270 will be described in greater detail subsequently.

In the case of the third one [125' (alternate)] of said three new stations shown in FIG. 21 (which, also, is optional and not always present in all forms of the invention), the modified abrasive particle(s) applicatory station designation, 125' (alternate) of new FIG. 21, clearly indicates that it is only a very slight modification of the abrasive particle(s) applicatory station 125 of prior FIG. 20 (previously described in detail, and therefore, not again specifically described). The similar, or corresponding parts, are correspondingly designated.

The scissors jacks (mechanisms) and fluid-pressure-operated actuators (hydraulic or pneumatic double-action cylinders) of all of the five representative controllably insertable, controllably removable, and/or controllably interchangeable stations (or modules) are essentially the same as the first described one thereof shown at 205A and 210A in FIG. 20 (and comprising a part of the adhesive applicatory station 110A) and the duplicates thereof shown at **205*a* and 210*a* in FIG. 20 (and comprising a part of the abrasive applicatory station 125**). Therefore, said scissors jacks (mechanisms), actuators (cylinders), etc. (three additional, or extra, sets thereof) are designated by the same reference numerals followed by the next succeeding lower-case letters ("b", "c", and "d") and no additional detailed description of said essentially duplicated parts is thought to be either necessary or desirable—for redundancy reasons.

The scarifying material 265 may be any chemical which can penetrate and/or effectively attack the surface of the bristle end 60 so as to effectively increase the porosity (porous nature) of, and/or the roughness of, the surface of each bristle tip 60 brought into intimate contact therewith for an appropriate scarification period of time. In those instances where the bristle tip is made of smooth nylon plastic material, such materials may include phenol, resorcinal, various resorcinol derivatives, formaldehydes, various resorcinal-formaldehyde combinations, and other nylon penetrators, softeners and/or attacker-rougheners, etc—all within the broad scope of the novel method of the present invention.

Mechanical abrasion may also be employed for scarification. See FIG. 34 for one representative example of this.

It is important that the scarifying material 265 be applied to each bristle tip 60 in a controlled, limited fashion so the liquid scarifying material 265 remains in place—on only the bristle tip 60 and not on any of the rest of the bristle 55. In other words, it is important to effectively immobilize the liquid scarifying material 265 upon only the bristle tip 60, as best indicated in FIG. 9, and in the manner previously described in connection with the application of the adhesive matrix material (usually, epoxy resin, although not always so limited) 85A and 90 as shown in prior FIG. 5, for example.

If the optional bridging station of FIG. 21, 110B, is skipped, and if the appropriate sequential steps are repeated in a globule-size-increasing, multiple-lamination-producing step (or steps), an enlarged abrasive globule, such as that shown at 65 in FIG. 15 is produced.

Figure 10:
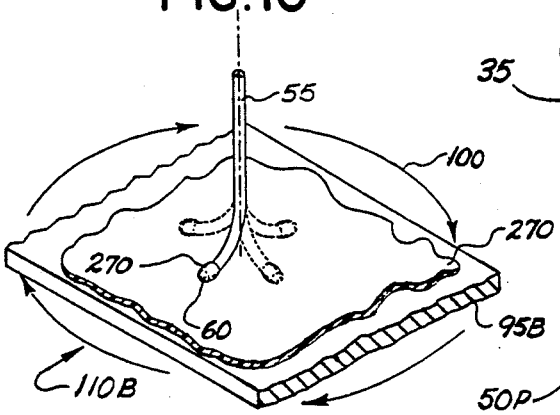
FIG. 10 is another fragmentary perspective view generally similar to FIG. 9, but shows a second one of the two additional steps referred to in the preceding paragraph as being part of the slight variation in the method of the present invention shown in FIGS. 9 and 10. This second slight variation step comprises the pre-coating step of effectively applying to the bristle tip end portion, *before* the first coating applicatory step shown in FIG. 5, an interjunctionary bridging (bonding) adhesive material which has a much greater affinity for each of the two different materials shown as being joined together in FIG. 5 than they have for each other, thus greatly increasing the strength of the effectively bridged junction therebetween.
Figure 14:
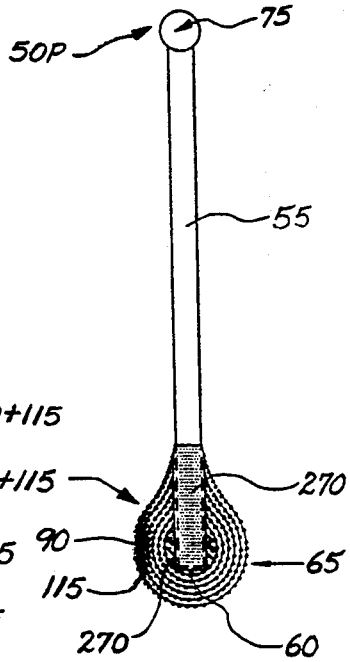
FIG. 14 is a view very much like FIG. 8, but shows a slightly modified, and junction-strength-increased, mounting of the enlarged abrasive globule on the bristle tip end, produced in one representative additional "bridging, etc." method step such as shown in FIG. 10, for example (although, not specifically so limited in all forms of the invention).
Figure 16:
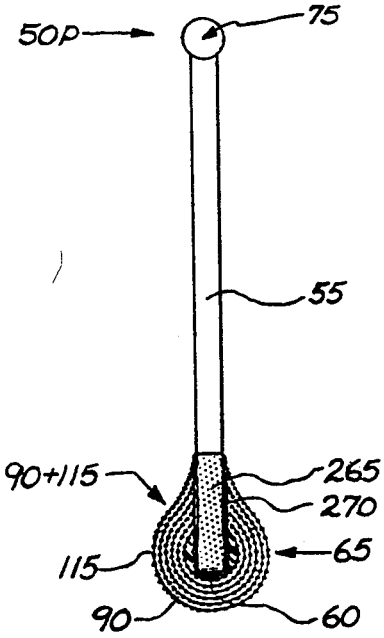
FIG. 16 is substantially a combination of FIGS. 14 and 15 and shows both types of junction-strength-increasing mounting of the enlarged abrasive globule on the bristle tip end, produced in this representative example, by sequentially using the additional "scarifying" method step shown in FIG. 9 (or effective equivalent), and then, the additional "bridging, etc." method step shown in FIG. 10 (or effective equivalent), although not specifically limited to the showing of either FIG. 9 or FIG. 10.

The "bridging" step shown diagrammatically in FIG. 10 is performed at the bridging station 110B shown in FIG. 21 and essentially consists of the controlled (and limited in a desired way) application of a suitable interjunctionary bridging material 270 to the exterior of each treated bristle tip 60, either an unscarified bristle tip 60 (as shown in FIGS. 10 and 14, for example) or a previously scarified bristle tip 60 (of the type shown in FIG. 9, for example). The combination applicatory and wiping-off relative motion employed in applying only just the right quantity of the bridging material 270 to each bristle tip 60 is extremely important, and when employed *without* previous scarification, and repeated until the desired number of laminations have been built-up, results in an enlarged abrasive globule 65 of the type shown in FIG. 14. With previous scarification, and the desired number of laminations, an enlarged abrasive globule 65 of the type shown in FIG. 16 is produced, which has the maximum adhesion-strength because of the use of both the scarification indicated at 265 and the interjunctionary bridging 270 (having a greater junction-affinity for each of the two joined-together materials—usually, nylon and epoxy resin, although not specifically so limited in all forms of the invention—than the junction-affinity which each of said two joined-together materials have for each other).

Of course, it is understood that the slightly modified form of the method of the present invention required to produce the FIG. 15 type of final enlarged abrasive globule 65 involves skipping the "bridging" step referred to hereinbefore, and in the performance of the novel, somewhat extended, method of the present invention by the exemplary (but non-limiting) apparatus shown in fragmentary diagrammatic form in FIG. 21, this means that the entire "bridging" station 110B is skipped—usually, by being effectively removed from (or not being, initially, involved as an effectively modular part of) the rest of the complete apparatus, or machine, shown in FIG. 21, wherein all (or at least, most) of the complete apparatus, or machine, is preferably of what might be considered to be "modular" construction, with respect to the various stations such that they can be effectively removed, replaced and/or interchanged as desired.

Similarly (that is, in a manner similar to the "modular" removable, replaceable and/or interchangeable construction feature referred to in the preceding paragraph), it should be understood that the slightly modified form of the method of the present invention required to produce the FIG. 14 type of final enlarged abrasive globule 65 involves skipping the "scarification" step referred to hereinbefore, and in the performance of the novel, somewhat extended, method of the present invention by the exemplary (but non-limiting) apparatus shown in fragmentary diagrammatic form in FIG. 21, this means that the entire "scarification" station 110S is skipped—usually, by being effectively removed from (or not being, initially, included as an effectively modular part of) the rest of the complete apparatus, or machine shown in FIG. 21.

The "bridging" material indicated at 270 in FIGS. 10, 14 and 21 may be any bonding and/or adhesive interjunctionary material which has a greater attraction-affinity for each of the two materials (usually, two different materials) of which each bristle tip 60 and of each adhesive coating layer (lamina) 90 is made so as to effectively provide an adhesive-strength-enhanced bridging junction between the material of the bristle tip 60 and the material of the immediately-outwardly-adjacent next coating layer (or lamina) 90 which is substantially stronger than would otherwise be the case with a direct junction between said two materials made without the interjunctionary "bridging" step.

In one exemplary form of the novel method of the present invention where the bristle tip material 60 is nylon plastic resin material (one of a group of structurally protein-like synthetic polymeric amides, usually made from coal, air and water, etc.), and where the adhesive matrix coat (or coating) layer (or lamina) 90 is made of an initially liquid (or semi-liquid) epoxy resin material, the bridging material 270, in one preferred (but non-limiting) form of the invention may comprise resorcinol and/or a resorcinol-formaldehyde synthetic resin, which is somewhat similar to (or related to) the previously mentioned scarifying material 265 in certain forms of the novel method of the present invention and may include various resorcinol, formaldehyde, and/or resorcinol-formaldehyde synthetic plastic resins (both full strength and diluted—usually, water-diluted, although not so limited in all forms of the invention) or effective functional equivalents thereof.

In one exemplary form of implementation of the novel method of the present invention, the previously-mentioned scarifying material 265 may be diluted (in part so as to reduce not only its concentration, but its composite size, when carried by a bristle tip, etc.) and scarification of the nylon bristle tip occurs to a desired (or pre-planned) extent. Then the scarified bristle tip (actually, the plurality of same) may proceed directly on (forward) to the next operative modular station (either 110B or 110A, depending upon the desires, and modular station selections of, an operator of the machine shown in FIG. 21) for appropriate further processing as previously described. On the other hand, and alternatively, the scarification 265 on the bristle tip 60 may first be dried (which might be considered by some to be a low-temperature cure) before proceeding on to the next desired step of the previously described series of modular (removable, replaceable and/or interchangeable) steps of the novel, somewhat extended, method of the present invention, one exemplary (and non-limiting) form of which is shown fragmentarily and diagrammatically in FIG. 21.

The hereinbefore-mentioned drying of the scarification material 265 (where that is desired) may be accomplished (and/or performed) in any suitable manner. One such, would be to provide an extra (auxiliary) drying (or curing) station somewhat like the previously-described, final-step, main curing station shown at 130 in FIG. 21 (although not so limited) and to modularly place it immediately beyond (after, in the flowpath) the scarification station 110S, at a location such as indicated at 111 on FIG. 21, where a relatively low curing temperature can be applied, usually, for a relatively short curing and hardening time—although neither is specifically so limited (and further taking into account variations thereof due to ambient temperature and/or humidity conditions, etc.).

Then, the scarification material 265 may be reapplied and may be again dried by effectively repeating the scarification and drying steps described in the two preceding paragraphs. This may be done by effective "recycling" movement and/or reversing-and-repeating movement or by next adding to the sequence of stations two more duplicating stations just like the original scarifying station 110S and the immediately following extra (auxiliary) drying station indicated at the original location 111, although not so limited.

In certain forms of the novel method of the present invention, the duplication and/or doubling-up type of action mentioned in the preceding paragraph [there, with reference to the main scarification station 110S and the following extra (auxiliary) drying station indicated at 111]may also be employed following (and immediately after) the main "bridging" station 110B of FIG. 21 at the location indicated at 112 on FIG. 21, for example (although not so limited). These two modifications will allow both the scarification material 265 and the bridging material 270 to be applied twice (or more times) and dried (or cured) twice (or more times) before going on to the next epoxy-resin-coating step in the next station 110A' in FIG. 21.

It should be noted that in some forms of the novel method of the invention, the scarification material 265, and/or the bridging material 270, and/or the adhesive plastic matrix coating material (85A' on the table 95A' and 90 on individual bristle tips 60) may be multi-part materials adapted to have at least some of the parts applied separately. This can be handled very readily by the method of the present invention and by a revised form of the machine shown in FIG. 21—revised by the addition of whatever number of additional stations (similar to station 110A', for example) are required to perform the separate application to each bristle tip 60 of all such separately applicable parts of any or all of such multi-part scarification material 265, such multi-part bridging material 270 and/or such multi-part adhesive plastic matrix coating material 85A'-90', etc., interspersed by whatever additional curing stations (such as the exemplary one shown at 130 in FIG. 21, although not so limited) are thought to be needed to optimize the joining process and the strength of the junction resulting therefrom and effectively attaching the final resultant enlarged abrasive globule 65 to the bristle tip 60.

In view of the immediately preceding paragraph, it is obvious that the multi-station-supplemented version (or modification) of the FIG. 21 form of one exemplary (non-limiting) modular machine which may be employed in practicing the novel method of the present invention, lends itself well to the use of relatively complex and/or many-step applicatory procedures and processes. For example, (non-limiting) one such relatively complex and many-step applicatory procedure might be described approximately as follows.

The scarifying material 265 and/or the bridging material 270 (one or the other, or each) may comprise a multi-component plastic resin, such as a two-component resorcinol-formaldehude synthetic resin, for example, of which one component can be applied, in liquid form, to each bristle tip 60 by one of the "wiping action" stations similar to that shown at 110S in FIG. 21 (although not so limited), while a second component thereof (effectively comprising a "hardener" thereof) is additionally and subsequently similarly applied to the first-component-coated bristle tip 60 in order to effectively harden it in place. The two-component resorcinol-formaldehyde synthetic resin has a great affinity for the synthetic plastic material (usually nylon) of which the bristle tip 60 is made and, also, has a great affinity for the adhesive plastic matrix coating layer material 85A'-90 (usually an epoxy resin), which is repetitively applied (and firmly attached) to the preceding layers (of course, after the subsequent application of the abrasive particles 115 as shown in station 125' in FIG. 21) until an enlarged abrasive globule 65 (such as is shown in FIG. 16) is built up. Said enlarged abrasive globule 65 is wear-attritionable, primarily with respect to the adhesive plastic matrix coating layer 90 (usually epoxy resin) because it is softer than the abrasive particles 115, which thus effectively project from the globule no matter how much the globule is worn down as a result of extensive honing usage thereof.

In certain forms of the invention, each bristle tip which is to be coated is arranged to be initially enlarged before the previously-described sequence of method steps begins.

Figure 11:
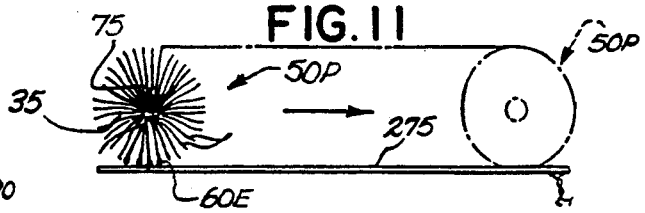
FIG. 11 is a greatly-reduced-in-size, largely diagrammatic view, in general side elevation, illustrating another slight variation in the basic first method of the present invention which comprises a first step to be performed before any of the others and comprising the effective enlargement of each bristle tip end portion into what might be termed an integral enlarged "bead" or tip-end-ball, which has a larger-than-before surface area upon which the multiple abrasive laminations can be subsequently firmly adhesively mounted as shown in sequence in FIGS. 5, 6, 7 and 8, or as shown in FIGS. 9, 10, 5, 6, 7 and 8 in that slight variation of the basic method of the present invention.
Figure 12:
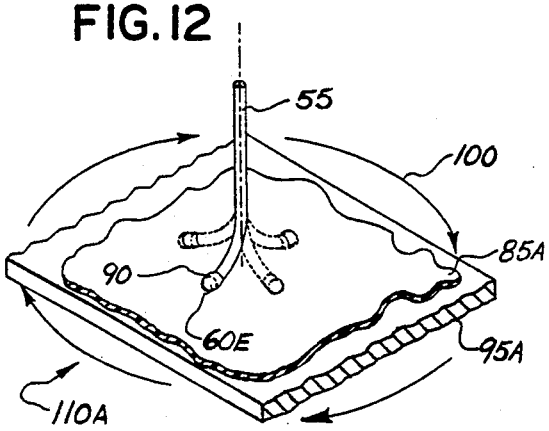
FIG. 12 is a view very similar to FIG. 5, but shows the single exemplary flexible bristle as being one of the slightly modified bristles having enlarged bristle tip end portions or "beads", such as those produced by the method step shown very diagrammatically in FIG. 11, for example, although not so limited.
Figure 13:
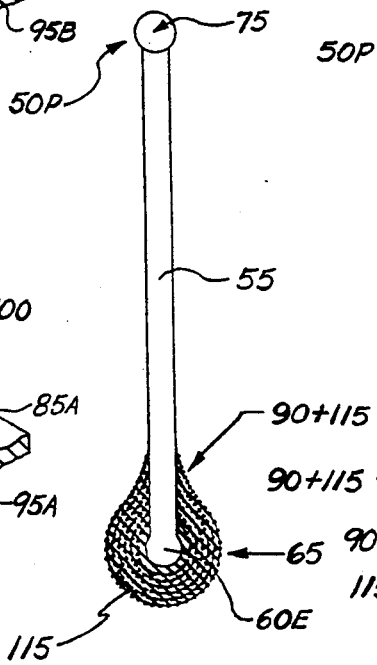
FIG. 13 is quite similar to FIG. 8, but shows a typical final configuration of a representative one of the plurality of bristle-tip-end-mounted multi-layer, composite, multi-phase-material abrasive globules, mounted, however, on and around such an enlarged bristle tip end or "bead", such as that produced by the method step shown in FIG. 11, for example, (although, not specifically so limited).

This may be accomplished by starting with already pre-existing bristles 55 which already have pre-enlarged bristle-tip-end beads 60E, or by starting with ordinary bristles 55 and then effectively modifying the conventional bristle tips 60 into the enlarged bristle tip end-beads 60E. One exemplary (but non-limiting) procedure for producing such enlarged beads 60E on the ends of thermoplastic bristles 55 is shown somewhat diagrammatically in FIG. 11, where the plurality of conventional bristles 55 and bristle tips 60 carried by a typical hone preform 50P are relatively moved against a heated plate (or panel) 275 and then rolled therealong in the direction of the movement-indicating arrow until all of the initially regular bristle tips 60 have come into forced contact with the heated panel 275 for a period of time long enough to effectively deform the bristle tips 50 into the enlarged beads 60E. This is only illustrative and is not intended to be limiting in any way.

In any event, however the enlarged-bead-type-of bristle tip end 60E is achieved (or initially provided), it can be seen that it (said beaded tip end 65E) can then be treated in accordance with any or all of the different steps involved in the novel method of the present invention and previously described in detail hereinbefore while specifically referencing certain immediately hereinafter identified Figures of the accompanying drawings, thus eliminating the necessity for repeating, in particularized detail, the corresponding previously detailed descriptions with respect, however, to additional (or new) drawing FIGS. 12 and 13, FIG. 18, FIG. 17 and FIG. 19, which correspond, respectively, to earlier-described-in-detail FIGS. 5 and 8, FIGS. 9 and 15, FIGS. 10 and 14, and FIG. 16, respectively; the only difference being that in the latter, four-variation group of FIGS. 12 and 13, 18, 17 and 19, the treated bristle tip, in each instance, is of the enlarged bead 60E type instead of the regular, non-enlarged, ordinary bristle tip 60 type. Otherwise, the two different (but fully comparable) four-variation groups of Figures are identical and the method steps depicted therein are identical. Thus, the earlier detailed descriptions applied to FIGS. 5 and 8, FIGS. 9 and 15, FIGS. 10 and 14, and FIG. 16, are also fully applicable to the above-identified corresponding latter four variation group of FIGS. (12 and 13, 18, 17 and 19) and are hereby so applied. Any further description thereof would be repetitive and, therefore, obviously redundant.

Figure 22:
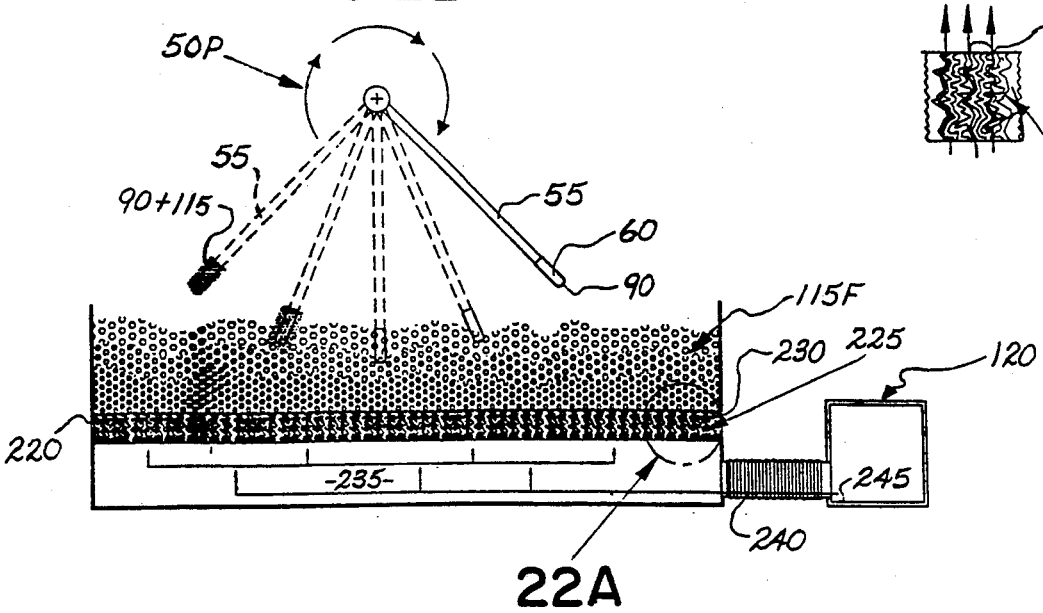
FIG. 22 fragmentarily and diagrammatically illustrates one exemplary, non-limiting variation of the abrasive-particle-applying step (shown in broken lines in FIG. 20, in part) wherein the abrasive particles are effectively suspended in a fluidized bed (or an effective air slurry, etc.) to optimize the application of the abrasive particles to the semi-liquid adhesive plastic matrix material layer (usually, epoxy resin, although not specifically so limited) and to minimize any "wiping off" action which might otherwise be present.
Figure 22A:
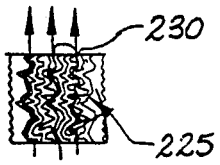
FIG. 22A is a fragmentary enlargement of that portion of FIG. 22 positioned within the circle indicated by the arrow 22A in FIG. 22.

The alternate abrasive particles applicatory station 125' of FIG. 21, as shown in somewhat more detail in fragmentary diagrammatic form in FIG. 22, uses the upward-air-flow-fluidized bed 115F of the abrasive particles 115 to effectively apply the abrasive particles 115 to the epoxy resin adhesive coating 90 while minimizing lateral "wiping-off" friction as each bristle tip 60 is moved through said bed 115F of abrasive particles 115 . The rest of the slightly revised mode of operation of this method step has been adequately described elsewhere in this present specification and, therefore, will not again be described now.

Also, it is believed that the very slightly modified mode of operation of the very slightly modified alternate curing chamber shown fragmentarily and diagrammatically at 135R in FIG. 23, as comprising the curing station 130, has been adequately described elsewhere in this present specification and, therefore, does not need further detailed description. It should suffice to say that each bristle tip adhesive-abrasive coating 90+115 carried at the tip end of each of the broken-away and separated representative few bristles 55 is subjected to appropriate curing heat (radiant heat, as shown) for an appropriate curing time emanating from suitable electric heating element means 280 while positioned within the curing chamber 135R to properly cure the composite coat 90+115, which can be said at this stage to comprise what might be termed a pre-globule 90+115, which after curing and appropriate repetition (effectively comprising a globule-size-increasing, multiple-lamination-producing step), will become a final enlarged abrasive globule such as any of those indicated at 65 in any of the various Figures of the drawings. In one non-limiting example of the arrangement just described, a slightly-elevated-above-ambient temperature may be applied to each such pre-globule 90+115 for a short curing time duration of approximately an hour, or less. However, more (or less) of each may be needed depending upon a number of variables including, but not being limited to: (1) the varying composition of the material comprising the pre-globule 90+115; (2) the size of the pre-globule 90+115; (3) the number of laminations of the pre-globule 90+115; (4) the layer-thickness of each layer of the pre-globule 90+115; (5) the ratio of curable material (such as epoxy resin and/or the scarifying material and/or the bridging material) to the non-curable material (such as abrasive particles—silicon carbide, or the like), and pertinent other variables and/or parameters, etc. In certain cases, the "cure" may be at ambient temperature and the previously mentioned "required physical conditions for the hardening and curing of the composite abrasive-matrix material (each such pre-globule 90+115)" may comprise time, alone (although, not so limited). The example given hereinbefore is, therefore, to be understood as merely being representative, but not limiting.

Similarly, it is believed that the operation of the further slightly modified curing chamber shown fragmentarily and diagrammatically at 135UV in FIG. 24, as comprising the curing station 130, has been entirely adequately disclosed and described elsewhere in this present specification to an extent such as to make a further detailed description thereof unnecessary. It should suffice to say that the curing step disclosed in FIG. 24 is very similar to the previously described curing step disclosed in FIG. 23 excepting only a change in the type of radiation used to effectively cure each fragmentarily shown pre-globule 90+115 carried on each fragmentarily shown bristle 55 from radiant heat as shown in prior FIG. 23 to ultraviolet radiation as shown in FIG. 24, which of course, requires that the curable material of each globule 90+115 shown in FIG. 24 be of a different composition from that of the pre-globule 90+115 shown in FIG. 23—a composition characterized by being curably responsive to ultra violet radiation, etc. It should be understood that this is representative only and non-limiting.

Figure 25:
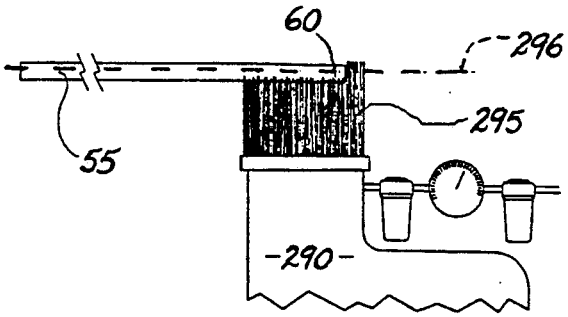
FIG. 25 is a skeletonized, diagrammatic side view of a first exemplary, non-limiting modification of the adhesive-applicatory (or adhesive-applying) step (by relative rotative-movement, brush application) in one portion of its 360-degree relative rotative-movement relationship to the engaged bristle tip end portion of the straight-ended single bristle shown fragmentarily.
Figure 26:
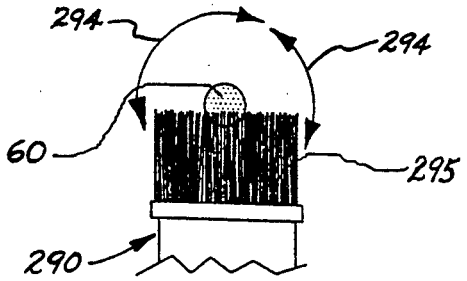
FIG. 26 is a skeletonized, diagrammatic end view of FIG. 25 (slightly enlarged, however).

FIGS. 25 and 26 illustrate one exemplary slight variation of the relative movement comprising the applicatory step and/or the immobilizing step previously described in detail and various exemplary forms of which are shown in FIGS. 5, 9, 10 and 12, for example.

In the non-limiting example shown in FIGS. 25 and 26, said slightly varied relative movement is that indicated by the curved directional arrows 294 of FIG. 26 (or the substantial reverse thereof) where said relative movement of the bristle tip 60 with respect to an applicatory brush 295 is substantially around an imaginary longitudinal axis coincident with a longitudinal centerline 296 of the bristle 55 and the bristle tip 60. This kind of relative applicatory movement 294 can be caused entirely by rotation of the bristle tip, or entirely by rotation of the applicatory brush 295 around the bristle tip 60 and its longitudinal center line (and effective axis) 296, or by some of both types of rotary movement inasmuch as the desired type of relative movement (relative rotation, as shown) results from any of same.

The applicatory brush 295 is placed in communication with just the bristle tip portion 60 of the single, representative, fragmentarily shown bristle for applying the liquid epoxy resin coating material (such as that previously shown at 90, for example) to just the bristle tip and for doing so in a controlled, limited fashion so as to effectively comprise the effective equivalent of the previously referred-to, so-called "immobilizing step" for effectively limiting the amount of liquid epoxy resin left on the bristle tip 60 after completion of an applicatory operation (or step) to an amount too little to move (substantially) along the length of the bristle 55 and away from the original bristle tip application area thereof at 60. This may be effectively accomplished virtually entirely by the relative rotary "wiping action" of the brush 295, entirely by effectively limiting the amount (quantity) of the liquid epoxy resin (or equivalent) supplied to the brush 295, itself, or by any effective combination thereof.

The above-mentioned liquid epoxy resin (or equivalent)) may be supplied to the applicatory brush 295 (usually, in a desired controlled and/or limited manner) from any suitable source thereof (one exemplary and non-limiting form thereof which is shown fragmentarily and diagrammatically at 290), from which the liquid epoxy can be fed to the brush 295 in any appropriate manner, such as capillary action, surface-tension-effect-caused "wicking" action, pressurized, force-feeding action, or effective equivalent.

Of course, the foregoing description of FIGS. 25 and 26 is not limited to applying the previously described epoxy resin adhesive liquid matrix coating material 90, but can be said to be equally appropriate to the application of the previously described scarifying material 265 and/or the previously described bridging material 270, as needed or desired.

Figure 27:
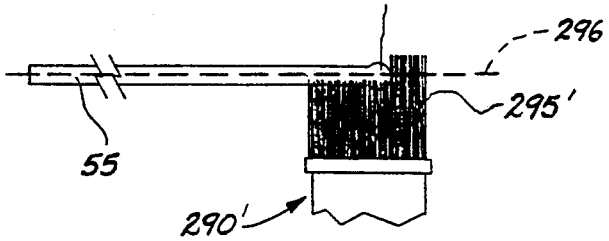
FIG. 27 is a side view very similar to FIG. 25, but illustrates the FIGS. 25 and 26 type of applicatory step slightly modified (or adapted) for better applicatory cooperation with a bristle tip end portion of the FIG. 11 and FIG. 13 type having an enlargement, or bead, on its outer end.
Figure 28:
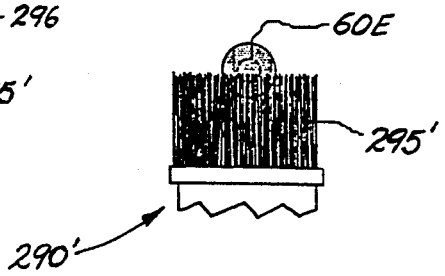
FIG. 28 is a skeletonized, diagramatic end view of FIG. 27 (slightly enlarged, however).

FIGS. 27 and 28 are very similar to just-described FIGS. 25 and 26, respectively, and therefore, do not need to be described in particularized detail, because such would be redundant. The main differences between the showing of the just-described version of FIGS. 25 and 26 and the showing of FIGS. 27 and 28 arise from the fact that the fragmentarily shown, single representative bristle 55 of FIGS. 27 and 28 is of the type previously described in detail and having an initially enlarged tip end comprising an effective bead 60E on the end of the bristle shaft 55. Also, the applicatory brush 295 of prior FIGS. 25 and 26 has been very slightly (and correspondingly) modified for better cooperation with the enlarged tip end bead 60E. Otherwise, the arrangement shown in FIGS. 27 and 28 functions identically to the previously described operation of the showing of FIGS. 25 and 26. Similar brush and source parts are primed, however.

Figure 29:
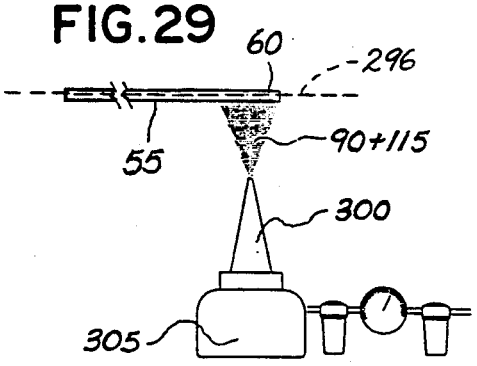
FIG. 29 is another very simplified, diagrammatic side view, of an aspect similar to FIG. 25, and illustrates a further slight modification of the applicatory step (accomplished by controlled, limited-spray application while relative rotative-movement occurs).
Figure 30:
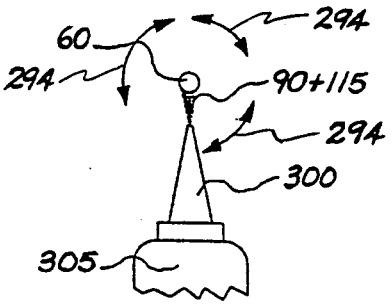
FIG. 30 is a simplified, diagrammatic end view of FIG. 29 (slightly enlarged, however).

FIGS. 29 and 30 are very similar to FIGS. 25 and 26, with the main difference being the substitution, in FIGS. 29 and 30, of the applicatory, controlled-limited-flow spray nozzle 300 for the previously shown (and previously fully described) applicatory brush 295 of FIGS. 25 and 26, and the substitution, in said FIGS. 29 and 30, of an appropriate spray nozzle reservoir (pressurized, or pressurizable liquid-epoxy-resin source) 305 for the previously shown (and previously fully described) epoxy resin (or equivalent) source 290 of FIGS. 25 and 26. Otherwise, the controlled, limited flow, spray-nozzle application of the previously-described liquid adhesive matrix coating material 90 (usually, epoxy resin or equivalent) to the bristle tip 60 only is functionally (and operationally) very similar to that previously described in detail with respect to FIGS. 25 and 26 and, therefore, need not again be described in specific detail.

Of course, the foregoing description of FIGS. 29 and 30 is not limited to applying the previously described epoxy resin adhesive liquid matrix coating material 90, but can be said to be equally appropriate to the application of the previously described scarifying material 265 and/or the previously described bridging material 270—and/or even to the preiously described particulate abrasive material 115, in certain instances where this is thought to be desirable.

FIGS. 31 and 32 are very similar to just-described FIGS. 29 and 30, respectively, and therefore, do not need to be described in particularized detail, because such would be redundant. The main differences between the showing of the just-described version of FIGS. 29 and 30 and the showing of FIGS. 31 and 32 arise from the fact that the fragmentarily shown, single representative bristle 55 of FIGS. 31 and 32 is of the type previously described in detail and having an initially enlarged tip end comprising an effective bead 60E on the end of the bristle shaft 55. Also, the applicatory spray nozzle 300 of prior FIGS. 29 and 30 may have been very slightly (and correspondingly) modified (or, perhaps, had the spray pattern of said nozzle adjusted) for better (or optimum) cooperation with the enlarged tip end bead 60E. Otherwise, the arrangement shown in FIGS. 31 and 32 functions virtually identically to the previously-described operation of the showing of FIGS. 29 and 30. Similar nozzle and source parts are primed, however.

FIG. 33 is similar to the showing of FIGS. 5, 9, 10 and 12 for applying the various different applicatory materials (85A–90, 265 and/or 270, etc.) through the use of the novel applicatory method of the present invention with the only significant difference therefrom being the novel applicatory relative movement itself (formerly designated by reference number 100 and designated by the reference numeral 100' in FIG. 33, because of its slight modification). As shown in FIG. 33, said relative movement 100' is of a generally figure-eight configuration, but is to be broadly construed as merely indicative of any of a number of different relative movement configurations which may be employed within the broad scope of the novel method of the present invention. Otherwise, the method is as previously fully described (or any substantial equivalent thereof) and needs no further description for that reason.

Figure 34:
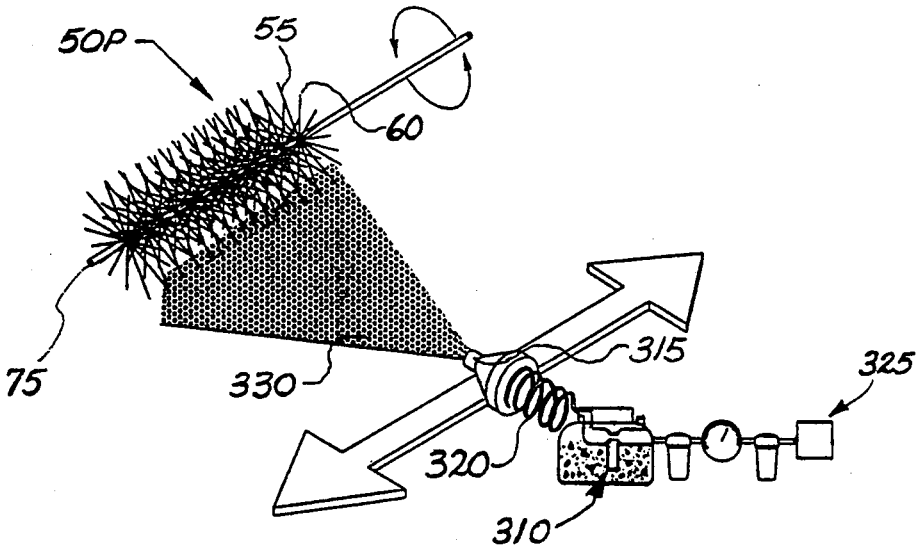
FIG. 34 is a view generally similar to FIG. 1, as to the composite multi-bristle-and-core brush construction (although in an early preliminary stage before any bristle-tip-end coating-applicatory operations have occurred). It is shown with its bristle tip ends being subjected to a modified type of scarifying (or scarification) operation, which is of a mechanical type—in this case, comprising a sand-blasting and/or bead-blasting operation for appropriately scarifying the bristle tip end portions.

FIG. 34 merely illustrates one of many possible modifications of the previously fully-described "scarification" step such as the exemplary one shown at the "scarification" (or "scarifying") station 110S in FIG. 21 and FIG. 9, for example. In the non-limiting, exemplary, "scarification" modification step illustrated in FIG. 34, the scarifying step is of a mechanical type wherein a pressurized source of "beads" (or sand, or the like) indicated generally at 325 feeds a nozzle 315 through an intervening supply duct 320 (or the effective equivalent) so as to cause a pressurized blast of the abrasive beads (sand, silica glass beads, or equivalent) 330 to be directed more or less laterally against the bristle tips 60 of the bristles 55 of the hone preform 50P while the preform 50P is rotated around the twisted wire bristle-mounting base 75 so that all of the bristle tips 60 get equally bead-blasted (or sand-blasted) for the desired scarification (roughening) of the bristle tips 60. An alternate aspirated source 310 of the beads 330 may be used if desired.

FIG. 35 illustrates another exemplary, representative, non-limiting variation in the applicatory relative movement step (and in the means for producing same) used in applying any of the different types of liquid (or semi-liquid) material to each bristle tip in the previously-described, controlled, limited manner whereby to be effectively immobilized on each bristle tip only in a virtually non-running manner. It is shown in FIG. 35 as a replacement for the apparatus shown in FIG. 21 in the so-called bridging station 110B, but could just as well be used in lieu of the apparatus shown in FIG. 21 in the scarifying station 110S or the apparatus shown in FIG. 21 in the adhesive station 110A'.

As shown in FIG. 35, an upper table 340 carrying the liquid (or semi-liquid) applicatory material 335 thereon is spring-mounted by coil springs (such as four corner-mounted coil springs 345, although not so limited) by attachment of bottom ends of said coil springs 345 to corresponding upper portion of a lower positioned mounting platform 350. A drive motor 355 rotates a lower drive pulley sheave 360, which drives the V-belt 365, which causes driven rotation of a second upper driven pulley sheave 370, which operates a well-known type of multi-bar linkage, commonly known in the art as a four-bar-linkage 375, which is operatively coupled to the previously-mentioned upper table 340 in a manner which will cause the upper table 340 to be effectively relatively (usually reversibly) moved in a multi-directional-component manner (such as is generally indicated at 380) which results in moving the upper table relative to each already-moving bristle tip 60 in a curved, reversing manner somewhat different from the relative movements previously described, such as the representative relative applicatory movements shown at 100 in FIG. 20A and 101 in FIG. 20B, for example.

Numerous modifications and variations of both the method and the equipment employed in implementing the novel method of the present invention are within the broad scope of the present invention and are intended to be included and comprehended herein along with manual (human-individual) performance of any or all of the various steps of the novel method of the present invention.

For one non-limiting example only, it should be noted that while each of the vertical movement actuators, such as 210A and **210*a* of FIG. 20, and 210*b*, 210*c* and 210A', 210*a*' and 210*d* of FIG. 21 are effectively preprogrammed in one form of the invention in a manner correlated with the advancing movement of the conveyor 145 of FIG. 20 and the conveyor 145' of FIG. 21 and consequently correlated with the positions of the hone preforms 50P so the appropriate table (or tables) will be vertically moved up into operative position when the conveyor-advanced preforms 50P are directly over the beginning portions of the corresponding tables; and will, conversely, lower said table (or tables) below operative position when the corresponding hone preform (or preforms) reaches (reach) the ending portion (or portions) of the corresponding table (or tables). Such preprogramming may be incorporated in a (not shown) main control and correlation center controlling and correlating all of the actuators in the desired manner for proper appropriately timed operation of the complete machine of FIG. 20 and/or of FIG. 21. On the other hand, the entire machine of FIG. 20 and/or of FIG. 21 can be made effectively self-controlled and/or self-correlated by providing electrically-operated control valves (forward and reversing, etc.) for each of the hydraulic (or pneumatic) vertical-movement-causing actuators and by placing (1) relatively movable switches and (2) switch-operating cams (or other operators) at multiple appropriate locations along the path of travel of the conveyor 145 (or 145') and/or along the path of travel of the hone preforms 50P for abutment (and operation) at (or adjacent to) the beginning and ending portions of corresponding ones of said vertically adjustable tables so that the proper ones of said electrically operated control valves will be operated in a table-raising manner with respect to the corresponding hydraulic (or pneumatic) actuator when a hone preform, while being advanced by the conveyor, arrives at the beginning portion of a corresponding one of said tables—and so that the opposite (or reverse) switch abutment (and operation) will occur when said hone preform 50P is advanced to, and reaches the ending portion of the corresponding one of said tables, thus automatically causing the raising and lowering of the various tables at the proper times relative to the forward movement of the hone preforms. The control switches can be movably carried by the conveyor 145 (or 145'**) or by the hone preforms (or mountings thereof), while the switch-operating cams (or other operators) can be mounted adjacent to said beginning and ending portions of each of said tables positioned, at least partially, in the path of travel of the corresponding abuttable one of said conveyor-moved switches for appropriate switch operation at the proper time when a hone preform reaches said starting portion of a corresponding table, and also, when it reaches said ending portion of said table. Positions of switches and operators can be relatively reversed, if desired.

The extent of the vertical movement of any of said vertically movable tables may be similarly effectively self-controlled and self-correlated by placing vertically spaced-apart electrical limit switches effectively at (or adjacent to) upper and lower table-operative and table-inoperative height locations and by placing a switch operator on (or correlated with) the vertically-adjustable table and arranged to limit upward and downward travel of a corresponding one of said vertically-movable tables to movement between a predetermined upper operative position and a lower inoperative position. Positions of switches and operators can be relatively reversed if desired.

Alternatively, said table-height-adjusting actuators, such as those shown at 210A and **210*a* in FIG. 20 or those shown at 210*b*, 210*c*, 210A', 210*a*' and 210*d* in FIG. 21**, may be modified to comprise electrically-powered actuators of any suitable type, such as controllably reversible, electric-motor-driven, lead screws, or solenoid-type actuators, electromagnetically-operated actuators of various latching and/or non-latching types, any (or all) of which are easily controlled by multiple control switches and switch operators to provide for proper and correlated control of vertical-movement-timing and vertical-movement-magnitude, as referred to in the preceding two paragraphs relative to providing such "timing" control and such "height-adjustment" control (both up and down) when said table-height-adjusting actuators are of the originally-described fluid-pressure-operated type. All such "timing" control and "height-adjustment" control modes of operation (method steps), and/or representative apparatuses for implementing same, are intended to be effectively included within the broad scope of the novel method of the present invention.

Various other effectively equivalent control and correlation methods (and apparatuses for implementing said methods) can be employed in lieu of the foregoing disclosures, and all such are intended to be included within the broad scope of the novel method of the present invention.

Figure 20D:
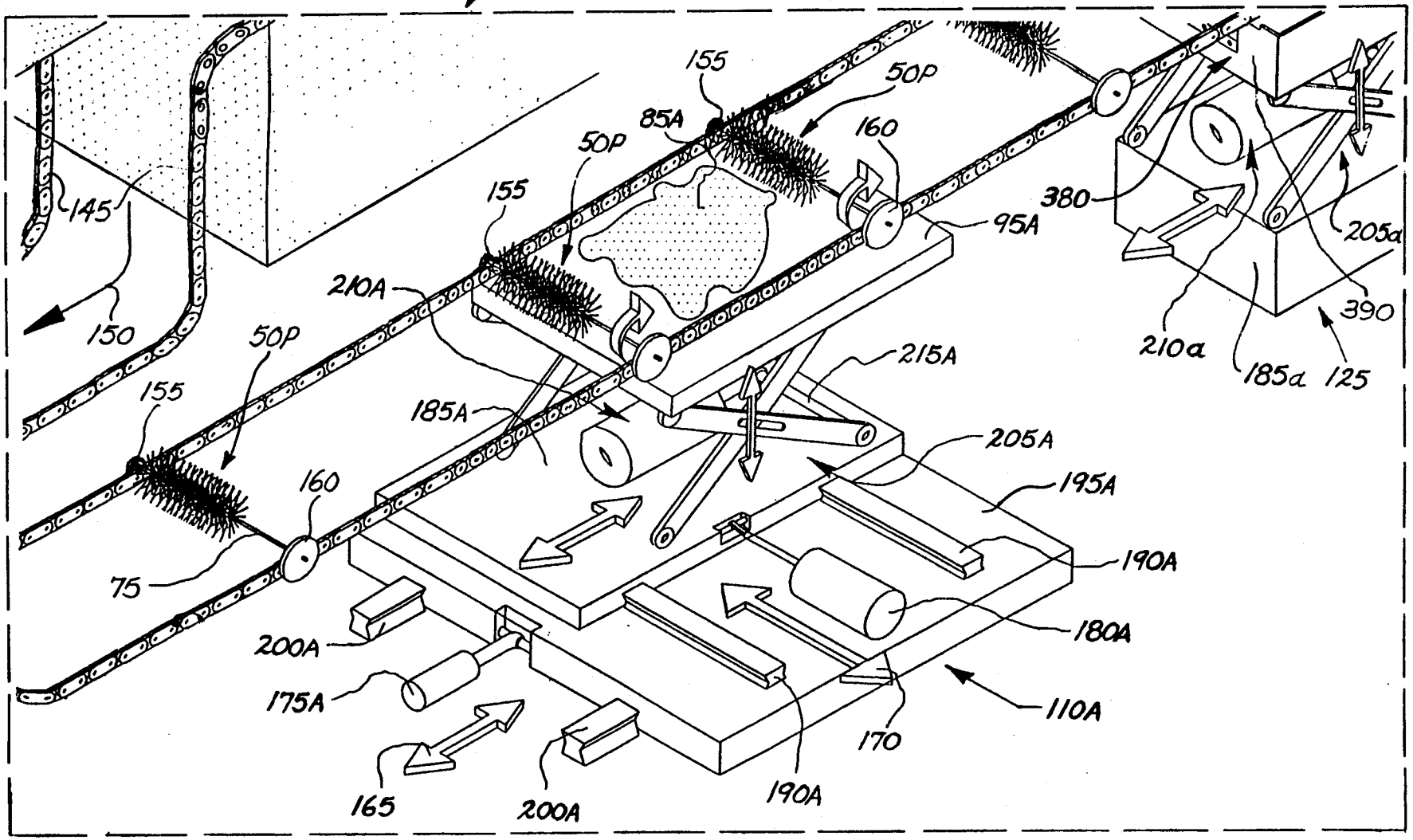
FIG. 20D is a fragmentary enlargement of the lower left corner portion of FIG. 20.
Figure 21A:
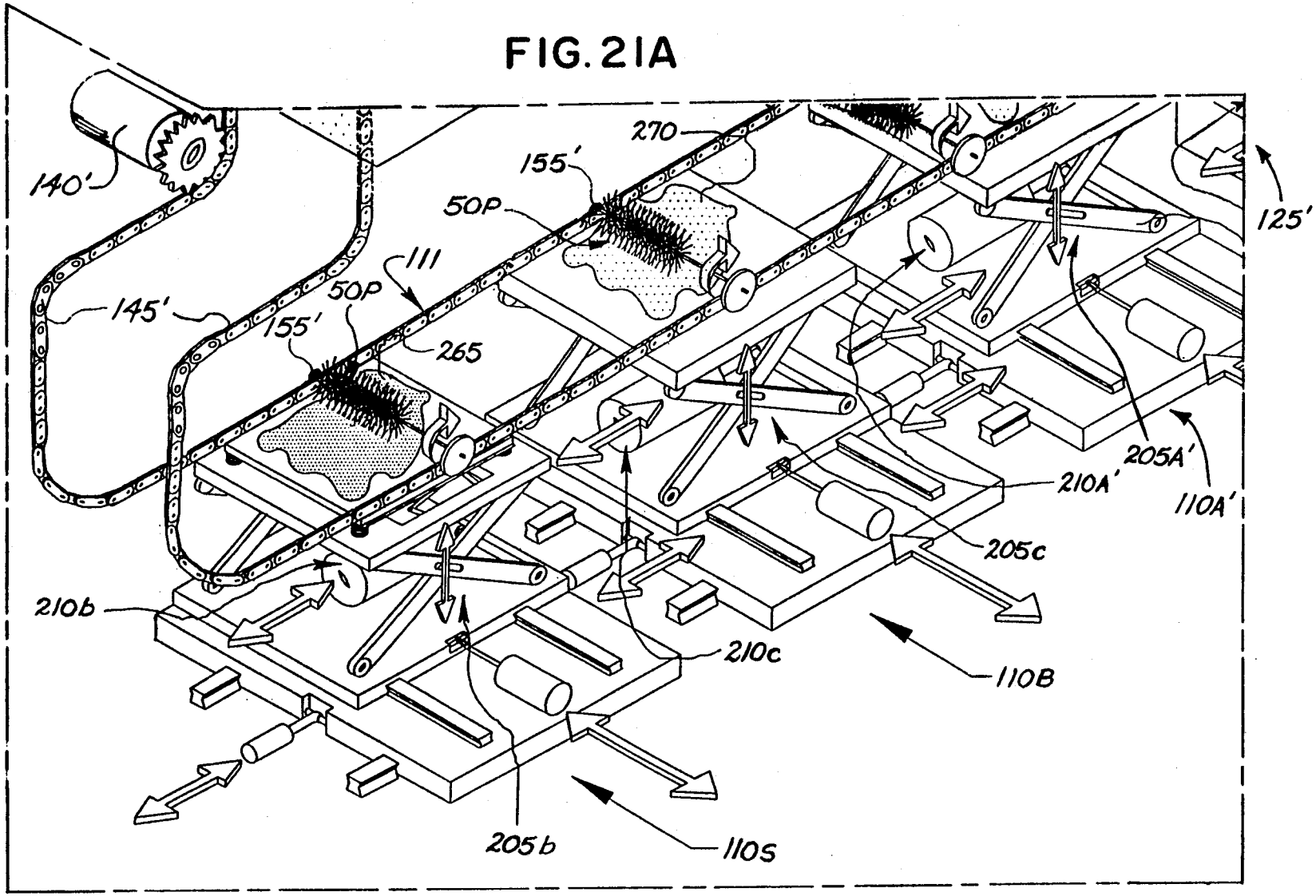
FIG. 21A is a fragmentary enlargement of the lower left corner portion of FIG. 21.
Figure 21B:
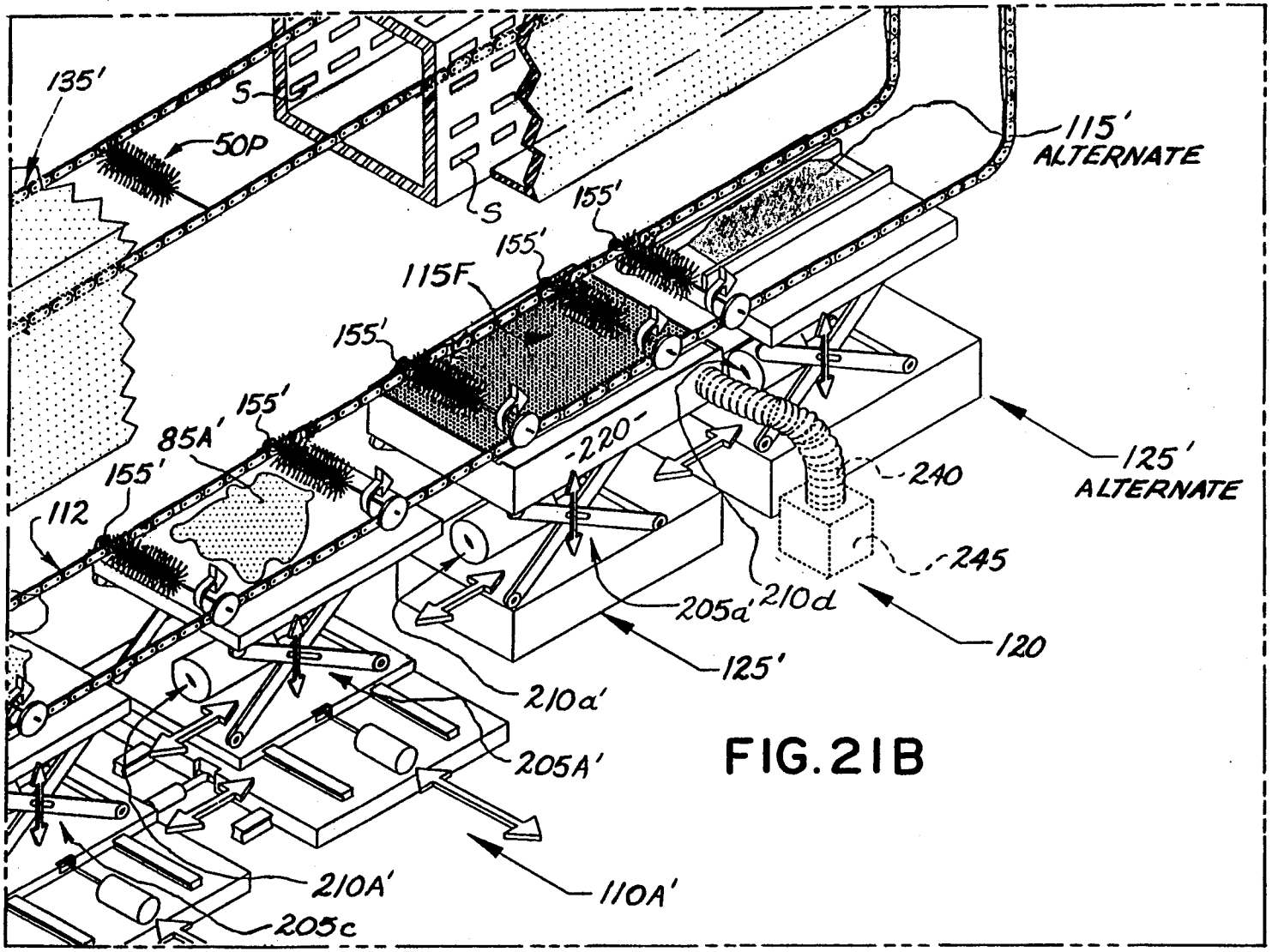
FIG. 21B is a fragmentary enlargement of the lower right corner portion of FIG. 21—that portion located immediately to the right of FIG. 21A.

Incidentally, in connection with the consideration of various possible modifications and/or variations of the novel basic method of the present invention that are entirely within its scope, it should be noted that, in some instances, it may be thought desirable to divorce, isolate, and/or separate the hereinbefore-mentioned so-called, "relative curved wiping movement" or "rotative wiping movement" or "rotary wiping movement", etc. (such as shown at 100 in FIG. 20A or shown at 101 in FIG. 20B, for example only) from the forwardly directed rolling movement of each preform 50P provided in one exemplary non-limiting form in FIG. 20 by the friction roller (or wheel) 160 rolling along an underlying surface (which is shown in FIG. 20 as being the surface 95A, but which is certainly not limited thereto). If desired, an underlying surface (for engaging and rotating the roller or wheel 160) which is completely separate from, and detached from, the rest of the surface 95A may be provided; and, if desired, it may be independently position-adjustable or it may be position-adjustable in a manner correlated with the elevation-adjustment operation of the independent rest of the table surface 95A. This modification, also, may apply to the other stations (including tables or the like, etc.) where each roller or (wheel) 160 is adapted to forwardly rotate a preform 50P and to the other FIGS. 20A, 20B, 20C, 20D, 20E and 20F and to FIGS. 21, 21A and 21B, etc. This type of modification may be achieved in many different ways—too many different ways to individually specifically detail same (which, obviously, would be redundant) and all such are intended to be included and comprehended within the broad scope of the present invention.

Numerous modifications and variations of the novel method of the present invention are within its scope, and this also applies to the various different exemplary and representative-only kinds of equipments and/or apparatuses specifically disclosed in the accompanying drawings and the present specification for implementing certain representative (but non-limiting) forms of the novel method of the present invention. Many effective equivalents thereof may be used in practicing the novel method of the present invention.

Many other variations also lie within the broad scope of the present invention and/or within an intended broad interpretation of the well-known "doctine of equivalents".

Insofar as the specifically described and referred-to exemplary method steps of the present invention are concerned, it should be noted that they are illustrative only and are not intended to be construed as limiting the invention only thereto. On the contrary, a reasonable range of equivalents is, also, intended to be effectively included herein. This also applies to the particular apparatuses illustrated in the accompanying drawings, which is/are exemplary only of many variations thereof which may be alternatively employed in practicing (implementing) the novel method of the present invention—and no specific limitations are to be construed therefrom, now.

What is claimed is:

1. A method for quickly and efficiently mass-producing a flexible abrasive hone initially including a plurality of flexible nylon plastic bristles and, after the performance of the following method steps, including a plurality of enlarged-abrasive-globule-carrying modified such flexible nylon plastic bristles, comprising the steps of:

first assembling a plurality of such flexible nylon plastic bristles and effectively firmly mounting bristle mounting portions with respect to a bristle-holding base, and doing so in a desired relatively evenly-laterally-spaced manner with respect to the base, and with bristle applicatory tip end portions being appropriately similarly longitudinally spaced, along the bristle lengths, from the base such that a corresponding plurality of the bristle tip end portions are correspondingly appropriately positioned at corresponding similar bristle-length-spaced pre-honing locations in closely-laterally-adjacent-to-each-other, but individual non-interfering positions, together defining an effective, multi-element, common-contiguous-surface flexibly supported pre-honing portion which is subsequently to be effectively converted into a flexibly-supported honing surface of such an abrasive-hone-to-be;

then, as a high-speed, mass-production, composite, multi-bristle-modifying operation, performed compositely with respect to a desired substantial number of the flexible bristle applicatory tip end portions, performing a first coating applicatory step taking the form of applying an at least semi-liquid, but controllably hardenable, effectively adhesive, plastic matrix means and material to each tip end portion of each desired bristle in a first exterior coat and lamina of said matrix means and material of a desired lamina thickness, as determined in part by the natural retention characteristics of each now first-coated bristle tip end portion upon termination of said first-coating applicatory step;

then, further, as a high-speed, mass-production, composite multi-bristle-modifying operation, performing an effective immobilizing step, wherein each said first exterior coat and lamina is then rotatingly, wipingly, and under pressure, thinned so as to become, and to subsequently be, substantially effectively immobilized against subsequent physical-positional, liquid-running displacement thereof relative to each bristle tip end portion to which said semi-liquid matrix means and material has been applied and which, thus, carries said first exterior coat and lamina thereon;

then, further, as a high-speed, mass-production, composite, multi-bristle-modifying operation, performing an abrasive particle, supplementary and additive applicatory step taking the form of bridging a quantity of usually initially dry additive abrasive particles of finely-divided particulate abrasive material into relative-non-lateral-displacement-causing insertive and penetrating, temporary, mating and bonding contact thereof with each said exterior coat and lamina of said matrix means and material while it is still in at least partially semi-liquid form and, thereby causing the effective picking-up of said abrasive particles by each said matrix means and material and the effective intermixing thereof into an effective two-phase, composite abrasive-matrix material; and then, further, as a high-speed, mass-production, composite, multi-bristle-modifying operation, performing a composite-material-hardening and composite-material-curing step taking the form of subjecting each said bristle tip end portion, carrying said coat and lamina, and now comprising said effective two-phase, composite abrasive-matrix material, to the particular required physical conditions needed for hardening and curing same, whereby to cause such hardening and curing of said composite abrasive-matrix material, comprising said exterior coat and lamina on each of said desired bristle tip end portions, to a desired extent.

2. A method for quickly and efficiently mass-producing a flexible abrasive hone initially including a plurality of flexible nylon plastic bristles and, after the performance of the following method steps, including a plurality of enlarged-abrasive-globule-carrying modified such flexible nylon plastic bristles, comprising the steps of:

first assembling a plurality of such flexible nylon plastic bristles and effectively firmly mounting bristle mounting portions with respect to a bristle-holding base, and doing so in a desired relatively evenly-laterally-spaced manner with respect to the base, and with applicatory bristle tip end portions being appropriately similarly longitudinally spaced, along the bristle lengths, from the base such that a corresponding plurality of the bristle tip end portions are correspondingly appropriately positioned at corresponding similar bristle-length-spaced pre-honing locations in closely-laterally-adjacent-to-each-other, but individual and non-interfering positions, together defining an effective multi-element, common-contiguous-surface flexibly supported pre-honing portion which is subsequently to be effectively converted into a flexibly-supported honing surface of such an abrasive-hone-to-be;

then, as a high-speed, mass-production, composite, multi-bristle-modifying operation, performed compositely with respect to a desired substantial number of the flexible applicatory bristle tip end portions, performing a first coating applicatory step taking the form of applying an at least semi-liquid, but controllably hardenable, effectively adhesive, plastic matrix means and material to each tip end portion of each desired bristle in a first exterior coat and lamina of said matrix means and material of a desired lamina thickness, as determined in part by the natural retention characteristics of each now first-coated bristle tip end portion upon termination of said first-coating applicatory step while said matrix means and material is still at least semi-liquid and before it is later hardened and cured;

then, further, as a high-speed, mass-production, composite, multi-bristle-modifying operation, performing an effective immobilizing step taking the form of substantially effectively, relatively non-movably fixing and immobilizing each said first exterior coat and lamina of each of said first-applied matrix means and material relative to each said corresponding bristle tip end portion to which said at least semi-liquid matrix means and material has been applied whereby to substantially inhibit and prevent positional displacement of liquid, or partially liquid, excess portions of said matrix means and material from occurring on, and along, each bristle tip end portion carrying same;

then, further, as a high-speed, mass-production, composite, multi-bristle-modifying operation, performing an abrasive particle supplementary and additive applicatory step taking the form of bringing a quantity of usually initially dry additive abrasive particles of finely-divided particulate abrasive material into relative-non-lateral-displacement-causing insertive and penetrating, temporary, mating and bonding contact thereof with each said exterior coat and lamina of said matrix means and material while it is still in at least partially semi-liquid form and, thereby causing the effective picking-up of said abrasive particles by each said matrix means and material and the effective intermixing thereof into an effective two-phase, composite abrasive-matrix material; and then, further, as a high-speed, mass-production, composite, multi-bristle-modifying operation, performing a composite-material-hardening and composite-material-curing step taking the form of subjecting each said bristle tip end portion, carrying said coat and lamina, and now comprising said effective two-phase, composite abrasive-matrix material, to the particular required physical conditions needed for hardening and curing same, whereby to cause such hardening and curing of said composite abrasive-matrix material, comprising said exterior coat and lamina on each said desired bristle tip end portions, to a desired extent.

3. A method as defined in claim 2, for efficiently producing a flexible hone and including said composite, multi-bristle-modifying operations for each desired bristle, and additionally including the performing of an operation-duplication step taking the form of repeating said abrasive-particle supplementary and additive applicatory step at desired, time-spaced-intervals to maximize the quantity of said additive abrasive particles effectively picked-up by, and effectively intermixed with, said at least partially semi-liquid matrix means and material coating each desired bristle tip end portion.

4. A method as defined in claim 2, for efficiently producing a flexible hone, and including said composite, multi-bristle-modifying operations for each desired bristle, and additionally including the performing, for each desired bristle tip portion of a globule-size-increasing, multiple-lamination-producing step taking the form of repeating said first coating applicatory step, said immobilizing step, said abrasive-particle applicatory step, said operation duplication step and said composite-material-hardening step a desired number of repetitions corresponding to a desired number of layer-on-layer laminations, produced thereby and, together, comprising a corresponding plurality of desired enlarged forms of abrasive globules, each virtually non-removably mounted upon a different tip end portion of a different one of said desired flexible bristles.

5. A method as defined in claim 2, for efficiently producing a flexible hone, and including said composite multi-bristle-modifying operations for each desired bristle, wherein said first coating applicatory step and said effective immobilizing step are effectively combined and take the form of placing each bristle tip end portion in forcible-biased, bristle-bending, and bristle-tip-end-portion-deflecting engagement with a usually substantially flat, matrix-coated, wiping surface, usually of a wiping platform, bearing a thin-layer film of said at least partially semi-liquid matrix means and material thereon and causing relative rotation and rotative movement to occur between each said forcibly deflected bristle tip end portion and said matrix-coated wiping surface until each matrix-coated bristle tip end portion has been effectively wiped therearound to an extent such as to remove any excess liquid, or partially liquid, or semi-liquid matrix means and material from said coated bristle tip end portion, which excess, otherwise, might tend to flow along the bristle and tend to become positionally displaced relative to the bristle.

6. A method for quickly and efficiently mass-producing a flexible abrasive hone initially including a plurality of flexible nylon plastic bristles and, after the performance of the following method steps, including a plurality of enlarged-abrasive-globule-carrying modified such flexible nylon plastic bristles, and wherein each such globule comprises an enlarged, multi-phase, initially-liquid-but-hardened-into-solid plastic abrasive globule firmly and fixedly and virtually non-accidentally-removably and non-detachably carried on the tip end portion of a corresponding different desired one of such flexible nylon plastic bristles, comprising the steps of:

first assembling a plurality of such flexible nylon plastic bristles and effectively firmly mounting bristle mounting portions with respect to a bristle-holding base, and doing so in a desired relatively evenly-laterally-spaced manner with respect to the base, and with the bristle tip end applicatory portions being appropriately similarly longitudinally spaced from the base such that a corresponding plurality of the bristle tip end portions are correspondingly appropriately positioned at corresponding similar bristle-length-spaced pre-housing locations in closely-laterally-adjacent-to-each-other, but individual and non-interfering positions, together defining an effective, multi-element, common-contiguous-surface flexibly supported pre-honing portion which is subsequently to be effectively converted into a flexibly-supported honing surface of such an abrasive-hone-to-be;

then, as a high-speed, mass-production, composite, multi-bristle-modifying operation, performed compositely with respect to a desired substantial number of the flexible bristle tip end applicatory portions, performing a first coating applicatory step taking the form of applying an at least semi-liquid, but controllably hardenable, effectively adhesive, plastic matrix means and material to each tip end portion of each desired bristle in a first exterior coat and lamina of said matrix means and material of a desired lamina thickness, as determined in part by the natural retention characteristics of each now first-coated bristle tip end portion upon termination of said first-coating applicatory step while said matrix means and material is still at least semi-liquid and before it is later hardened and cured;

then, further, as a high-speed, mass-production, composite, multi-bristle-modifying operation, performing an effective immobilizing step, wherein each said first exterior coat and lamina is then rotatingly, wipingly, and under pressure, thinned so as to become, and to subsequently be, substantially effectively immobilized against subsequent physical-positional, liquid-running displacement thereof relative to each bristle tip end portion to which said semi-liquid matrix means and material has been applied and which, thus, carries said first exterior coat and lamina thereon;

said first coating applicatory step and said effective immobilizing step being effectively combined and taking the form of placing each bristle tip end portion in forcibly-biased, bristle-bending, and bristle-tip-end-portion-deflecting engagement with a usually substantially flat, matrix-coated, wiping surface usually of a wiping platform, bearing a thin-layer film of said at least partially semi-liquid matrix means and material thereon and causing relative rotation and rotative movement to occur between each said forcibly deflected bristle tip end portion and said matrix-coated wiping surface until each matrix-coated bristle tip end portion has been effectively wiped therearound to an extent such as to remove any excess liquid, or partially liquid, or semi-liquid matrix means and material from each said coated bristle tip end portion, which excess, otherwise, might tend to flow along each bristle and then to become positionally displaced relative to said bristle;

performing an abrasive particle, supplementary and additive applicatory step taking the form of bringing a quantity of usually initially dry additive abrasive particles of finely-divided particulate abrasive material into relative-non-lateral-displacement-causing insertive and penetrating, temporary, mating and bonding contact thereof with each said exterior coat and lamina of said matrix means and material while it is still in at least partially semi-liquid form and, thereby causing the effective picking-up of said abrasive particles by each said matrix means and material and the effective intermixing thereof into an effective tow-phase, composite abrasive-matrix material;

performing an operation-duplication step taking the form of repeating said abrasive particle supplementary and additive applicatory step at desired, time-spaced intervals to maximize the quantity of said additive abrasive particles effectively picked-up by, and effectively intermixed with, said at least partially semi-liquid matrix means and material coating each desired bristle tip end portion;

performing a composite-material-hardening and composite-material-curing step taking the form of subjecting each said bristle tip end portion, carrying said coat and lamina, and now comprising said effective two-phase, composite abrasive-matrix material, to the particular required physical conditions needed for hardening and curing same, whereby to cause such hardening and curing of said composite abrasive-matrix material, comprising said exterior coat and lamina on each of said desired bristle tip end portions, to a desired extent; and performing, for each desired bristle tip end portion, a globule-size-increasing, multiple-lamination-producing step taking the form of repeating said first coating applicatory step, said immobilizing step, said abrasive-particle applicatory step, said operation-duplication step and said composite-material-hardening step a desired number of repetitions corresponding to a desired number of layer-on-layer laminations, produced thereby and, together, comprising a corresponding plurality of desired enlarged forms of abrasive globules, each virtually non-removably mounted upon a different tip end portion of a different one of said desired flexible bristles.

7. A method, as defined in claim 2, including, prior to performing said first coating applicatory step, the additional operation comprising performing a junction-enhancing bridging step taking the form of applying interjunctionary adhesive bonding material of an initially non-solid and uncured plastic type to the exterior surface of each desired bristle tip end portion of said plurality thereof, with said interjunctionary adhesive bonding material also being of a type characterized by having a first strong attraction affinity for the nylon plastic material forming each said desired bristle tip end portion, and, additionally, having a second strong attraction affinity for said plastic matrix means and material of each said first exterior coat and lamina, which is to be subsequently applied thereto immediately thereafter in said first coating applicatory step.

8. A method as defined in claim 2, including, prior to performing said first coating applicatory step, the additional operation comprising performing an adhesiveness-increasing bristle-tip-end-portion mounting-preparation step taking the form of effectively roughening and scarifying the otherwise smooth exterior surface of each bristle tip end portion of said plurality thereof, thus effectively increasing the useful surface area thereof available for adhesive purposes.

9. A method as defined in claim 2, including, prior to performing said first coating applicatory step, the additional operation comprising performing a first adhesiveness-increasing, bristle tip end portion mounting-preparation step taking the form of effectively enlarging each desired bristle tip end portion of said plurality thereof into an enlarged, ball-like, pre-mounting bristle tip end portion by applying deforming and enlarging heat and pressure to each desired bristle tip end portion of said plurality thereof made of meltable thermoplastic material.

10. A method as defined in claim 2, including, prior to performing said first coating applicatory step, the additional operation comprising:

performing a first adhesiveness-increasing, bristle tip end portion mounting-preparation step taking the form of effectively enlarging each desired bristle tip end portion of said plurality thereof into an enlarged, ball-like, pre-mounting bristle tip end portion by applying deforming and enlarging heat and pressure to each desired one of said plurality of said bristle tip end portions made of meltable thermoplastic material; and performing a second adhesiveness-increasing bristle-tip-end-portion mounting preparation step taking the form of effectively roughening and scarifying the otherwise smooth exterior surface of each said desired enlarged bristle tip end portion of said plurality thereof, thus effectively increasing the useful surface area thereof available for adhesive purposes.

11. A method as defined in claim 8, including, prior to performing said first coating applicatory step, the additional operation comprising performing a junction-enhancing bridging step taking the form of applying interjunctionary adhesive bonding material of an initially non-solid and uncured plastic type to the exterior surfaces of each desired one of the roughened and scarified bristle tip end portions, with said interjunctionary adhesive bonding material also being of a type characterized by having a first strong attraction affinity for the nylon plastic material forming each said bristle tip end portion, and, additionally, having a second strong attraction affinity for said plastic matrix means and material of each said first exterior coat and lamina of said plurality thereof, which is to be subsequently applied thereto immediately thereafter in said first coating applicatory step.

12. A method as defined in claim 9, including, prior to performing said first coating applicatory step, the additional operation comprising performing a junction-enhancing bridging step taking the form of applying interjunctionary adhesive bonding material of an initially non-solid and uncured plastic type to the exterior surfaces of the plurality of said desired enlarged bristle tip end portions, with said interjunctionary adhesive bonding material also being of a type characterized by having a first strong attraction affinity for the nylon plastic material forming each said desired bristle tip end portion of said plurality thereof, and, additionally, having a second strong attraction affinity for said plastic matrix means and material of each first exterior coat and lamina of said plurality thereof, which is to be subsequently applied thereto immediately thereafter in said first coating applicatory step.

13. A method as defined in claim 10, including, prior to performing said first coating applicatory step, the additional operation comprising performing a junction-enhancing bridging step taking the form of applying interjunctionary adhesive bonding material of an initially non-solid and uncured plastic type to the exterior surface of each desired one of the enlarged and roughened and scarified bristle tip end portions, with said interjunctionary adhesive bonding material also being of a type characterized by having a first strong attraction affinity for the nylon plastic material forming each said bristle tip end portion, and, additionally, having a second strong attraction affinity for said plastic matrix means and material of each first exterior coat and lamina of said plurality thereof, which is to be subsequently applied thereto immediately thereafter in said first coating applicatory step.

14. A method for quickly and efficiently mass-producing a flexible abrasive hone initially including a plurality of flexible bristles and, after the performance of the following method steps, including a plurality of enlarged-abrasive-globule-carrying modified such flexible bristles, comprising the steps of:

first assembling a plurality of such flexible bristles and effectively firmly mounting bristle mounting portions with respect to a bristle-holding base, and doing so in a relatively desired-laterally-spaced manner with respect to the base, and with the bristle applicatory portions being appropriately desirably-contiguously longitudinally spaced away from the base such that a corresponding plurality of the bristle applicatory portions are correspondingly appropriately positioned at desired laterally-contiguous pre-honing locations in close-laterally-adjacent-to-each-other, but individual and non-interfering positions, together defining an effective, multi-element, common-contiguous-surface flexibly supported pre-honing portion which is subsequently to be effectively converted into a flexibly-supported honing surface of such an abrasive-hone-to-be;

then, as a high-speed, mass-production, composite, multi-bristle-modifying operation, performed compositely with respect to a desired substantial number of the flexible bristle applicatory portions, performing a first coating applicatory step taking the form of applying an at least semi-liquid but controllably hardenable, effectively adhesive, matrix means and material to each applicatory portion of each desired bristle in a first exterior coat and lamina of said matrix means and material of a desired lamina thickness, as determined in part by the natural retention characteristics of each now first-coated bristle applicatory portion upon termination of said first-coating applicatory step while said matrix means and material is still at least semi-liquid before it is later hardened and cured;

said first coating applicatory step, also, effectively comprising an immobilizing step, in that the application of said matrix means and material to each said bristle applicatory portion of said plurality thereof is effectively controlled, modified, and limited such as to effectively cause the relatively non-movable fixing and immobilizing of each said first exterior coat and lamina of each of said first-applied matrix means and material relative to each said bristle applicatory portion to which said at least semi-liquid matrix means and material has been applied, whereby to substantially inhibit and prevent positional displacement of liquid or partially liquid, excess portions of each said matrix means and material from occurring on, and along, each said bristle applicatory portion of said plurality thereof carrying same;

then, further, as a high-speed, mass-production, composite, multi-bristle-modifying operation, performing an abrasive particle supplementary and additive applicatory step taking the form of bringing a quantity of usually initially dry additive abrasive particles of finely-divided particulate abrasive material into mating and bonding contact thereof with each said exterior coat and lamina of said matrix means and material while it is still in at least partially semi-liquid form and, thereby causing the effective picking-up of said abrasive particles of each said matrix means and material and the effective intermixing thereof into an effective tow-phase, composite abrasive-matrix material; and then, further, as a high-speed, mass-production, composite, multi-bristle-modifying operation, performing a composite-material-hardening and composite-material-curing step taking the form of subjecting each said bristle applicatory portion, carrying said coat and lamina, and now comprising said effective two-phase, composite abrasive-matrix material, to the particular required physical conditions needed for hardening and curing same, whereby to cause such hardening and curing of said composite abrasive-matrix material, comprising said exterior coat and lamina on each of said desired bristle applicatory portions, to a desired extent.

15. A method as defined in claim 14 for efficiently producing a flexible hone and including said composite, multi-bristle-modifying operations for each desired bristle, and additionally including the performing of an operation-duplication step taking the form of repeating said abrasive particle supplementary and additive applicatory step at desired, time-spaced intervals to maximize the quantity of said additive abrasive particles effectively picked-up by, and effectively intermixed with, said at least partially semi-liquid matrix means and material coating each desired bristle applicatory portion.

16. A method as defined in claim 14 for efficiently producing a flexible hone, and including said composite, multi-bristle-modifying operations for each desired bristle, and additionally including the performing, for each desired bristle applicatory portion, of a globule-size-increasing multiple-lamination-producing step taking the form of repeating said first coating applicatory step, said immobilizing step, said abrasive-particle applicatory step, said operation-duplication step and said composite-material-hardening step a desired number of repetitions corresponding to a desired number of layer-on-layer laminations, produced thereby and, together, comprising a corresponding plurality of desired enlarged forms of abrasive globules, each virtually non-removably mounted upon a different applicatory portion of a different one of said desired flexible bristles.

17. A method as defined in claim 14 for efficiently producing a flexible hone, and including said composite multi-bristle-modifying operations for each desired bristle, wherein said first coating applicatory step and said effective immobilizing step are effectively combined and take the form of placing each bristle applicatory portion in forcibly-biased, bristle-bonding, and bristle-applicatory-portion-deflecting engagement with a usually substantially flat, matrix-coated, wiping surface, usually of a wiping platform, bearing a thin-layer film of said at least partially semi-liquid matrix means and material thereon and causing relative rotation and rotative movement to occur between each said forcibly deflected bristle applicatory portion and said matrix-coated wiping surface until each matrix-coated bristle applicatory portion has been effectively wiped therearound to an extent such as to remove any excess liquid, or partially liquid, or semi-liquid matrix means and material from said coated bristle applicatory portion, which excess, otherwise, might tend to flow along the bristle and tend to become positionally displaced relative to the bristle.

18. A method, as defined in claim 14, including, prior to performing said first coating applicatory step, the additional operation comprising performing a junction-enhancing bridging step taking the form of applying interjunctionary adhesive bonding bridging material of an initially non-solid and uncured type to the exterior surface of each desired bristle applicatory portion of said plurality thereof, with said interjunctionary adhesive bonding and bridging material also being of a type characterized by having a first strong attraction affinity for the material forming each said desired bristle applicatory portion, and, additionally, having a second strong attraction affinity for said matrix means and material of each said first exterior coat and lamina, which is to be subsequently applied thereto immediately thereafter in said first coating applicatory step.

19. A method as defined in claim 14, including, prior to performing said first coating applicatory step, the additional operation comprising performing an adhesiveness-increasing, bristle-applicatory-portion mounting-preparation step taking the form of effectively roughening and scarifying the otherwise smooth exterior surface of each desired bristle applicatory portion of said plurality thereof, thus effectively increasing the useful surface area thereof available for adhesive purposes.

20. A method as defined in claim 14, including, prior to performing said first coating applicatory step, the additional operation comprising performing a first adhesiveness-increasing, bristle applicatory portion mounting-preparation step taking the form of effectively enlarging each desired bristle applicatory portion of said plurality thereof into an enlarged, somewhat ball-like, premounting bristle applicatory portion resembling a bead by applying deforming and enlarging heat and pressure to each desired bristle applicatory portion of said plurality thereof made of heat-deformable material.

21. A method as defined in claim 14, including, prior to performing said first coating applicatory step, the additional operation comprising: performing a first adhesiveness-increasing, bristle applicatory portion mounting-preparation step taking the form of effectively enlarging each desired bristle applicatory portion of said plurality thereof into an enlarged, somewhat ball-like, pre-mounting bristle applicatory portion resembling a bead by applying deforming and enlarging heat and pressure to each desired one of said plurality of said bristle applicatory portions made of heat-deformable material; and performing a second adhesiveness-increasing bristle-tip-end-portion mounting preparation step taking the form of effectively roughening and scarifying the otherwise smooth exterior surface of each said desired enlarged bristle applicatory portion of said plurality thereof, thus effectively increasing the useful surface area thereof available for adhesive purposes.

22. A method as defined in claim 19, including, prior to performing said first coating applicatory step, the additional operation comprising performing a junction-enhancing bridging step taking the form of applying interjunctionary adhesive bonding bridging material of an initially non-solid and uncured type to the exterior surfaces of each desired one of the roughened and scarified bristle applicatory portions, with said interjunctionary adhesive bonding bridging material also being of a type characterized by having a first strong attraction affinity for the material forming each said bristle applicatory portion, and, additionally, having a second strong attraction affinity for said matrix means and material of each said first exterior coat and lamina of said plurality thereof, which is to be subsequently applied thereto immediately thereafter in said first coating applicatory step.

23. A method as defined in claim 20, including, prior to performing said first coating applicatory step, the additional operation comprising performing a junction-enhancing bridging step taking the form of applying interjunctionary adhesive bonding bridging material of an initially non-solid and uncured type to the exterior surfaces of the plurality of said desired enlarged bristle applicatory portions, with said interjunctionary adhesive bonding bridging material also being of a type characterized by having a first strong attraction affinity for the material forming each said desired bristle applicatory portion of said plurality thereof and, additionally, having a second strong attraction affinity for said matrix means and material of said first exterior coat and lamina, which is to be subsequently applied thereto immediately thereafter in said first coating applicatory step.

24. A method as defined in claim 21, including, prior to performing said first coating applicatory step, the additional operation comprising performing a junction-enhancing bridging step taking the form of applying interjunctionary adhesive bonding bridging material of an initially non-solid and uncured type to the exterior surface of each desired one of the enlarged and roughened and scarified bristle applicatory portions, with said interjunctionary adhesive bonding bridging material also being of a type characterized by having a first strong attraction affinity for the material forming each said bristle applicatory portion, and, additionally, having a second strong attraction affinity for said matrix means and material of each said first exterior coat and lamina of said plurality thereof, which is to be subsequently applied thereto immediately thereafter in said first coating applicatory step.

* * * * *